US011546694B2

(12) United States Patent
Hashimoto et al.

(10) Patent No.: US 11,546,694 B2
(45) Date of Patent: Jan. 3, 2023

(54) SIGNAL PROCESSING DEVICE FOR FILTER COEFFICIENT GENERATION, SIGNAL PROCESSING METHOD, AND NON-TRANSITORY COMPUTER-READABLE RECORDING MEDIUM THEREFOR

(71) Applicant: Faurecia Clarion Electronics Co., Ltd., Saitama (JP)

(72) Inventors: Takeshi Hashimoto, Saitama (JP); Tetsuo Watanabe, Saitama (JP); Yasuhiro Fujita, Saitama (JP)

(73) Assignee: FAURECIA CLARION ELECTRONICS CO., LTD., Saitama (JP)

( * ) Notice: Subject to any disclaimer, the term of this patent is extended or adjusted under 35 U.S.C. 154(b) by 28 days.

(21) Appl. No.: 17/350,721

(22) Filed: Jun. 17, 2021

(65) Prior Publication Data

US 2021/0400387 A1 Dec. 23, 2021

(30) Foreign Application Priority Data

Jun. 18, 2020 (JP) ..... JP2020-105371

(51) Int. Cl.

| | |
|---|---|
| ***H04R 3/12*** | (2006.01) |
| ***H04R 3/04*** | (2006.01) |
| ***G10L 25/18*** | (2013.01) |
| ***H04R 29/00*** | (2006.01) |

(52) U.S. Cl.

CPC ..... *H04R 3/12* (2013.01); *G10L 25/18* (2013.01); *H04R 3/04* (2013.01); *H04R 29/002* (2013.01); *H04R 2499/13* (2013.01)

(58) Field of Classification Search

None

See application file for complete search history.

(56) References Cited

U.S. PATENT DOCUMENTS

| | | | | |
|---|---|---|---|---|
| 8,116,465 | B2 | 2/2012 | Asada | |
| 2005/0244012 | A1 | 11/2005 | Asada | |
| 2008/0033726 | A1* | 2/2008 | Kudoh | G10L 21/04 704/E21.017 |

(Continued)

FOREIGN PATENT DOCUMENTS

| | | | |
|---|---|---|---|
| JP | 2001-117595 | A | 4/2001 |
| JP | 2004-325284 | A | 11/2004 |
| JP | 2005-341534 | A | 12/2005 |

(Continued)

*Primary Examiner* — James K Mooney

(74) *Attorney, Agent, or Firm* — Foley & Lardner LLP

(57) ABSTRACT

A signal processing device according to aspects of the present disclosures comprises a measuring section configured to measure an impulse response between each of a plurality of speakers and a predetermined listening position, a Fourier transformer configured to obtain a frequency spectrum corresponding to each of the plurality of speakers by applying a Fourier transform, a phase adjustment amount calculator configured to calculate a phase adjustment amount for each frequency, a band detector configured to detect a leading phase band, a phase converter configured to convert a phase of the leading phase band to a lagging phase, and a filter coefficient generator configured to generate a filter coefficient based on the phase adjustment amount after conversion by the phase converter.

10 Claims, 17 Drawing Sheets

(56) References Cited

U.S. PATENT DOCUMENTS

| | | | | |
|---|---|---|---|---|
| 2009/0304213 | A1* | 12/2009 | Cook | H04S 1/002<br>381/300 |
| 2019/0342662 | A1* | 11/2019 | Fukue | H04R 1/24 |

FOREIGN PATENT DOCUMENTS

| | | | |
|---|---|---|---|
| JP | 2012-195791 | A | 10/2012 |
| JP | 2020-137040 | A | 8/2020 |
| JP | 2020-137041 | A | 8/2020 |

* cited by examiner

SIGNAL PROCESSING DEVICE FOR FILTER COEFFICIENT GENERATION, SIGNAL PROCESSING METHOD, AND NON-TRANSITORY COMPUTER-READABLE RECORDING MEDIUM THEREFOR

CROSS-REFERENCE TO RELATED APPLICATIONS

This application claims priority under 35 U.S.C. § 119 from Japanese Patent Application No. 2020-105371 filed on Jun. 18, 2020. The entire subject matter of the application is incorporated herein by reference.

BACKGROUND

Technical Field

The present disclosures relate to a signal processing device, a signal processing method, and a non-transitory computer-readable recording medium for the signal processing device.

Related Art

Conventionally, there has been known a signal processing technique using an IIR (Infinite Impulse Response) filter to compensate for a frequency characteristic of a sound signal.

SUMMARY

It is noted, however, the IIR filter has a relatively low frequency resolution, and it is difficult to accurately compensate for the frequency characteristic of the sound signal with the IIR filter. In this regard, it is considered to use other digital filters to compensate for the frequency characteristic of the sound signals. For example, with use of an FIR (Finite Impulse Response), it is possible to accurately compensate for the frequency characteristic of the sound signal because of its high frequency resolution.

However, it has also been known that, if the FIR filter is used for compensating the frequency characteristics of the sound signal, a so-called pre-echo is generated.

According to aspects of the present disclosures, there is provided a signal processing device, comprising a measuring section configured to measure an impulse response between each of a plurality of speakers and a predetermined listening position from a signal of each of sounds respectively output from the plurality of speakers at timings at which the sounds do not interfere with each other at the predetermined listening position and collected at the listening position, a Fourier transformer configured to obtain a frequency spectrum corresponding to each of the plurality of speakers by applying a Fourier transform to the impulse responses corresponding to each of the plurality of speakers, respectively, a phase adjustment amount calculator configured to calculate, based on the frequency spectrum corresponding to each speaker, a phase adjustment amount for each frequency of a sound signal input to a target speaker subjected to control of a phase of the sound signal, a band detector configured to detect a leading phase band in which a phase is a leading phase based on the phase adjustment amount for each frequency calculated by the phase adjustment amount calculator, a phase converter configured to convert a phase of the leading phase band detected by the band detector to a lagging phase, and a filter coefficient generator configured to generate a filter coefficient corresponding to the target speaker based on the phase adjustment amount after conversion by the phase converter.

According to aspects of the present disclosures, the band detector is configured to detect a band including a frequency at which the phase adjustment amount is equal to or larger than a predetermined threshold as the leading phase band.

According to aspects of the present disclosures, the band detector is configured to allocate the phase adjustment amount for each frequency calculated by the phase adjustment amount calculator to a positive phase adjustment amount or a negative phase adjustment amount, convert the negative phase adjustment amount to an absolute value, apply synthesis to the positive phase adjustment amount and the phase adjustment amount converted to the absolute values, and detect the leading phase band based on the phase adjustment amount for each frequency after the synthesis.

According to aspects of the present disclosures, the band detector is configured to apply smoothing to the phase adjustment amount for each frequency after the synthesizing in a frequency domain, and detect the leading phase band based on the phase adjustment amount for each frequency after the smoothing.

According to aspects of the present disclosures, the phase converter is configured to generate first lagging phase data in which a phase is shifted in a negative side every time a starting frequency of the leading phase band appears in the frequency domain, and generate second lagging phase data in which a phase is shifted in a negative side every time an ending frequency of the leading phase band appears in the frequency domain. The filter coefficient generator generates the filter coefficient based on the first lagging phase data and the second lagging phase data.

According to aspects of the present disclosures, the phase converter is configured to apply smoothing to the first lagging phase data and the second lagging phase data with respect to the frequency axis.

According to aspects of the present disclosures, the filter coefficient generator is configured to convert each of the first lagging phase data and the second lagging phase data to an impulse response, and obtain the filter coefficient by convoluting the impulse response obtained by converting the first lagging phase data and the impulse response obtained by converting the second lagging phase data, the convoluted impulse response being the filter coefficient.

According to aspects of the present disclosures, the signal processing device further comprises an FIR filter configured to convolute the filter coefficient generated by the filter coefficient generator into a sound signal to be input to the target speaker.

According to aspects of the present disclosures, there is provided a non-transitory computer-readable recording medium for a signal processing device. The recording medium containing computer-executable instructions which cause, when executed, the signal processing device to perform measuring an impulse response between each of a plurality of speakers and a predetermined listening position from a signal of each of sounds respectively output from the plurality of speakers at timings at which the sounds do not interfere with each other at the predetermined listening position and collected at the listening position, obtaining a frequency spectrum corresponding to each of the plurality of speakers by applying a Fourier transform to the impulse responses corresponding to each of the plurality of speakers, respectively, calculating, based on the frequency spectrum corresponding to each speaker, a phase adjustment amount for each frequency of a sound signal input to a target speaker subjected to control of a phase of the sound signal, detecting a leading phase band in which a phase is a leading phase based on the phase adjustment amount for each frequency, converting a phase of the leading phase band detected to a lagging phase, and generating a filter coefficient corresponding to the target speaker based on the phase adjustment amount after the converting.

According to aspects of the present disclosures, there is provided a signal processing method performed in a signal processing device including measuring an impulse response between each of a plurality of speakers and a predetermined listening position from a signal of each of sounds respectively output from the plurality of speakers at timings at which the sounds do not interfere with each other at the predetermined listening position and collected at the listening position, obtaining a frequency spectrum corresponding to each of the plurality of speakers by applying a Fourier transform to the impulse responses corresponding to each of the plurality of speakers, respectively, calculating, based on the frequency spectrum corresponding to each speaker, a phase adjustment amount for each frequency of a sound signal input to a target speaker subjected to control of a phase of the sound signal, detecting a leading phase band in which a phase is a leading phase based on the phase adjustment amount for each frequency, converting a phase of the leading phase band detected to a lagging phase, and generating a filter coefficient corresponding to the target speaker based on the phase adjustment amount after the converting.

DETAILED DESCRIPTION OF THE EMBODIMENTS

Hereinafter, an acoustic system 1 according to an embodiment of the present disclosures will be described with reference to the drawings.

Figure 1:
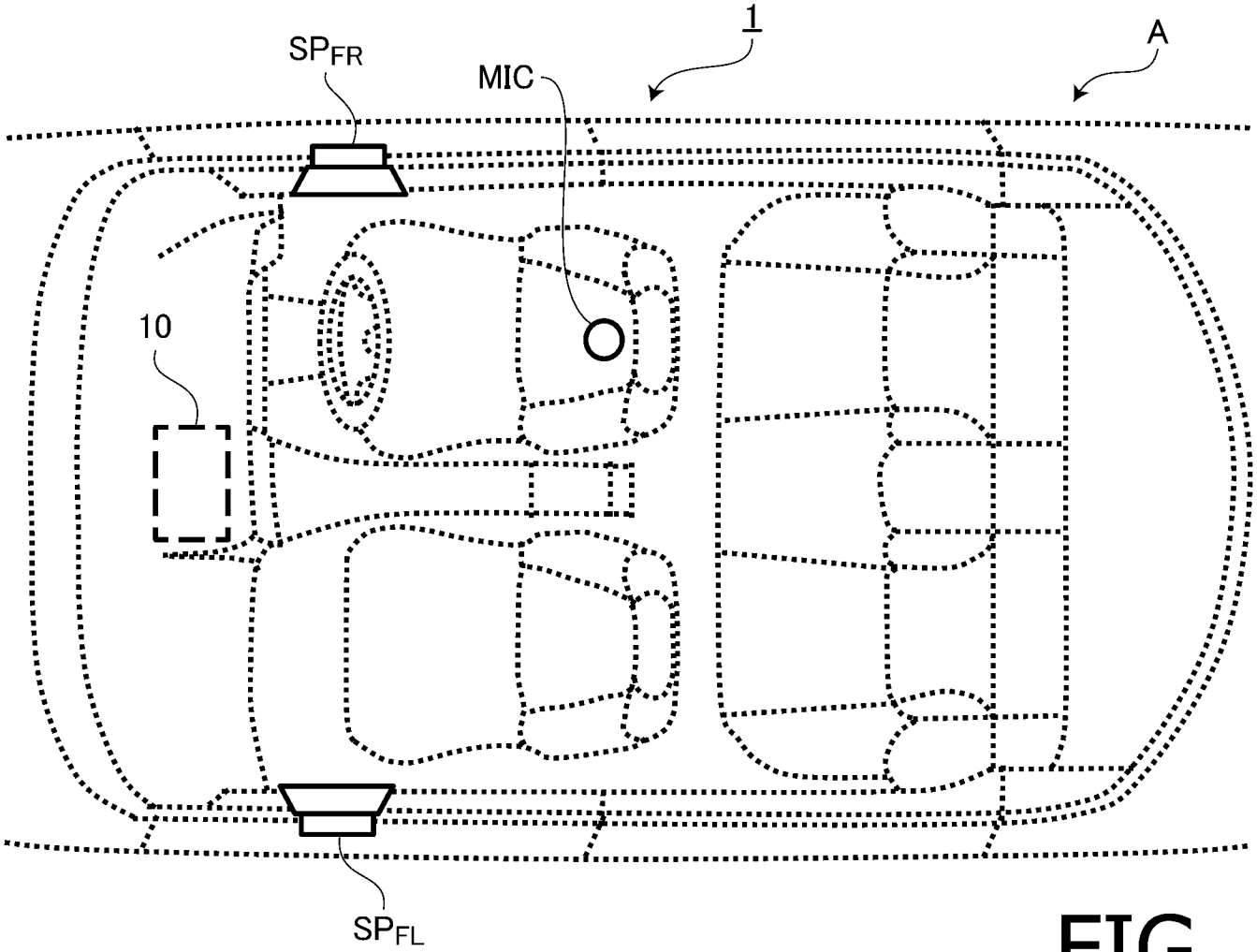
FIG. 1 schematically shows a vehicle in which an acoustic system according to an embodiment of the present disclosures is installed.
Figure 2:
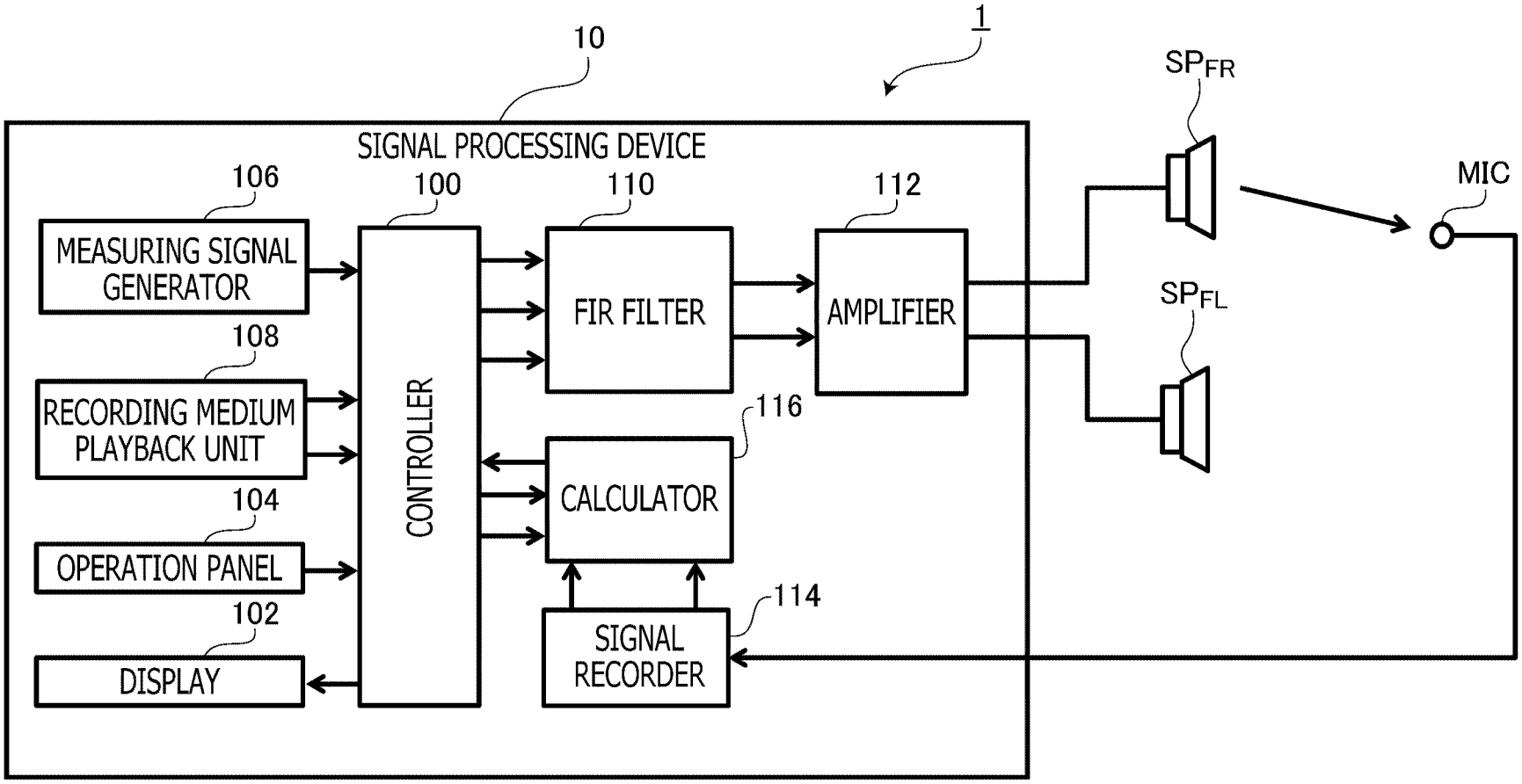
FIG. 2 is a block diagram of the acoustic system.

FIG. 1 schematically shows a vehicle A in which the acoustic system 1 is installed. FIG. 2 is a block diagram showing a configuration of the acoustic system 1.

As shown in FIGS. 1 and 2, the acoustic system 1 is equipped with a signal processing device 10, a pair of left and right speakers $SP_{FR}$ and $SP_{FL}$, and a microphone MIC.

The signal processing device 10 has an FIR filter to compensate for a frequency characteristic of a sound signal. The signal processing device 10 according to the present embodiment is configured such that an occurrence of a pre-echo is reduced while being configured to compensate for the frequency characteristic of the sound signal using the FIR filter.

It is noted that various processes in the signal processing device 10 are performed by cooperation of software and hardware provided in the signal processing device 10. At least an operating system (OS), which is a part of the software in the signal processing device 10, is provided as an embedded system, but other parts, such as a software module for performing a filter coefficient generation process for the FIR filter, may be provided as application software that can be distributed over a network or stored on a storage medium such as a memory card. In other words, a filter coefficient generation function according to the present embodiment may be a function that is built into the signal processing device 10 in advance (e.g., before shipment), or a function that can be added to the signal processing device 10 via a network or recording medium.

As shown in FIG. 1, a speaker $SP_{FR}$ is a right front speaker embedded in a right door section (e.g., a driver's side door section), and a speaker $SP_{FL}$ is a left front speaker embedded in a left door section (e.g., a front passenger's side door section).

As shown in FIG. 2, the signal processing device 10 has a controller 100, a display 102, an operation panel 104, a measuring signal generator 106, a recording medium playback unit 108, an FIR filter 110, an amplifier 112, a signal recorder 114, and a calculator 116.

Figure 3:
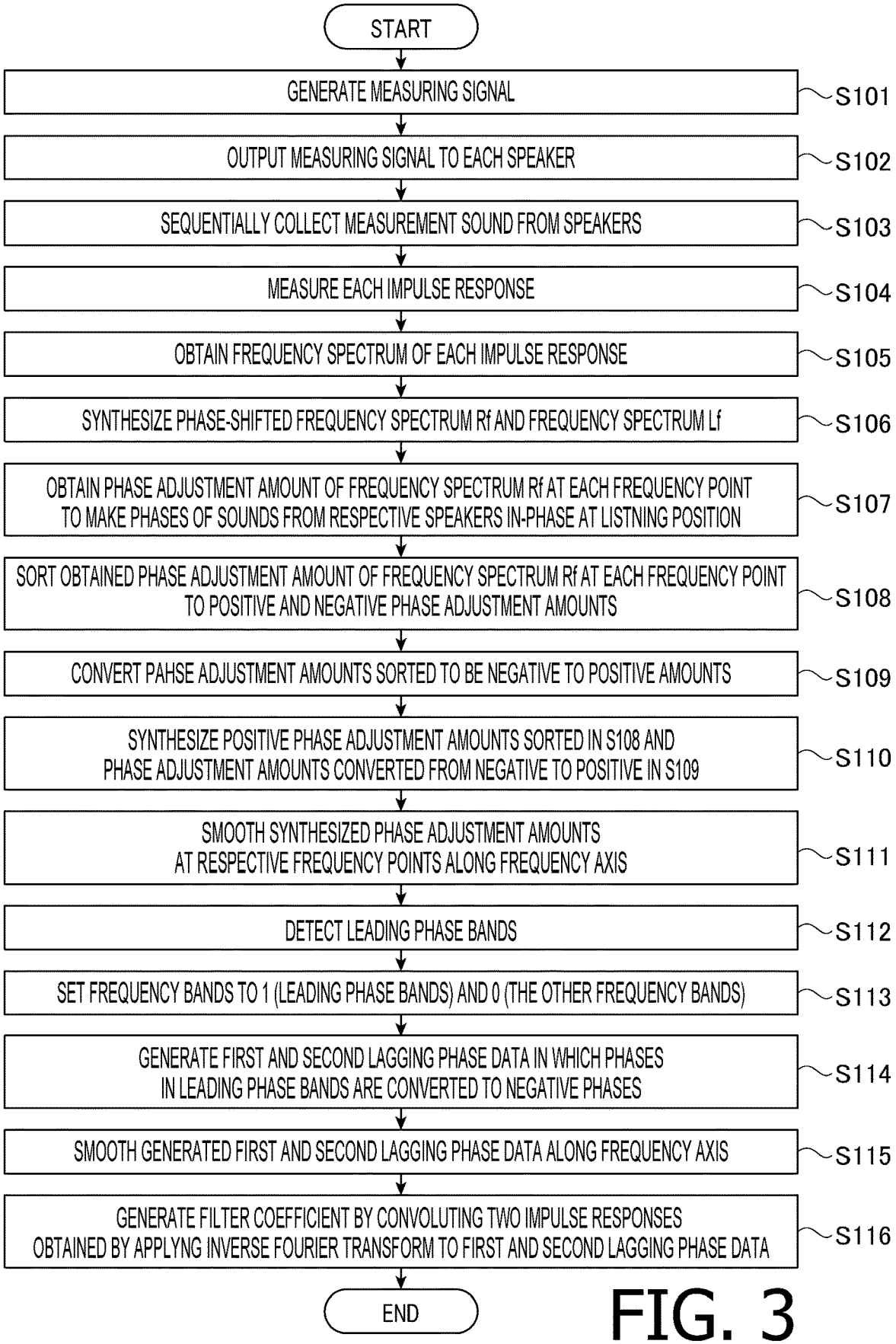
FIG. 3 is a flowchart illustrating a filter coefficient generation process performed by a signal processing device of the acoustic system.

FIG. 3 shows a flowchart illustrating the filter coefficient generation process for the FIR filter 110, which is executed in the acoustic system 1. Various processes in the acoustic system 1, including the filter coefficient generation process shown in FIG. 3, are executed under the control of the controller 100. When receiving a predetermined touch operation on the display 102 or a predetermined operation on the operation panel 104, the controller 100 starts executing the filter coefficient generation process shown in FIG. 3.

When the filter coefficient generation process shown in FIG. 3 is started, the measuring signal generator 106 generates a predetermined measuring signal (S101). The generated measuring signal is, for example, a signal representing an M-sequence (Maximal length sequence) code. The length (e.g., the number of bits) of the measuring signal may be at least twice the code length of the M-sequence code. The measuring signal may be of any other signal type, such as a TSP (Time Stretched Pulse) signal.

The measuring signal is passed through the controller 100 and the FIR filter 110 (i.e., a through output is performed), and is sequentially output to each of the speakers $SP_{FR}$ and $SP_{FL}$ through the amplifier 112 (S102). As a result, predetermined measuring sounds are sequentially output from the speakers $SP_{FR}$ and $SP_{FL}$ with a predetermined time interval.

The microphone MIC is installed in a position at which the pre-echo is to be reduced. In this embodiment, the microphone MIC is arranged at a driver's seat so that a listener sitting in the driver's seat does not perceive the pre-echo. The driver's seat where the listener is sitting will be hereinafter referred to as a "listening position."

The microphone MIC collects the sounds for measurement sequentially output from the speakers $SP_{FR}$ and $SP_{FL}$ at timings at which the sounds do not interfere with each other at the driver's seat (i.e., at the listening position). The signals (i.e., measured signals) representing the measuring sounds captured by the microphone MIC are stored in the signal recorder 114 and are input from the signal recorder 114 to the calculator 116 (S103). When the calculator 116 has a function to store the measured signals, the measured signals output from the microphone MIC are directly input to the calculator 116 without the signal recorder 114.

Figure 4:
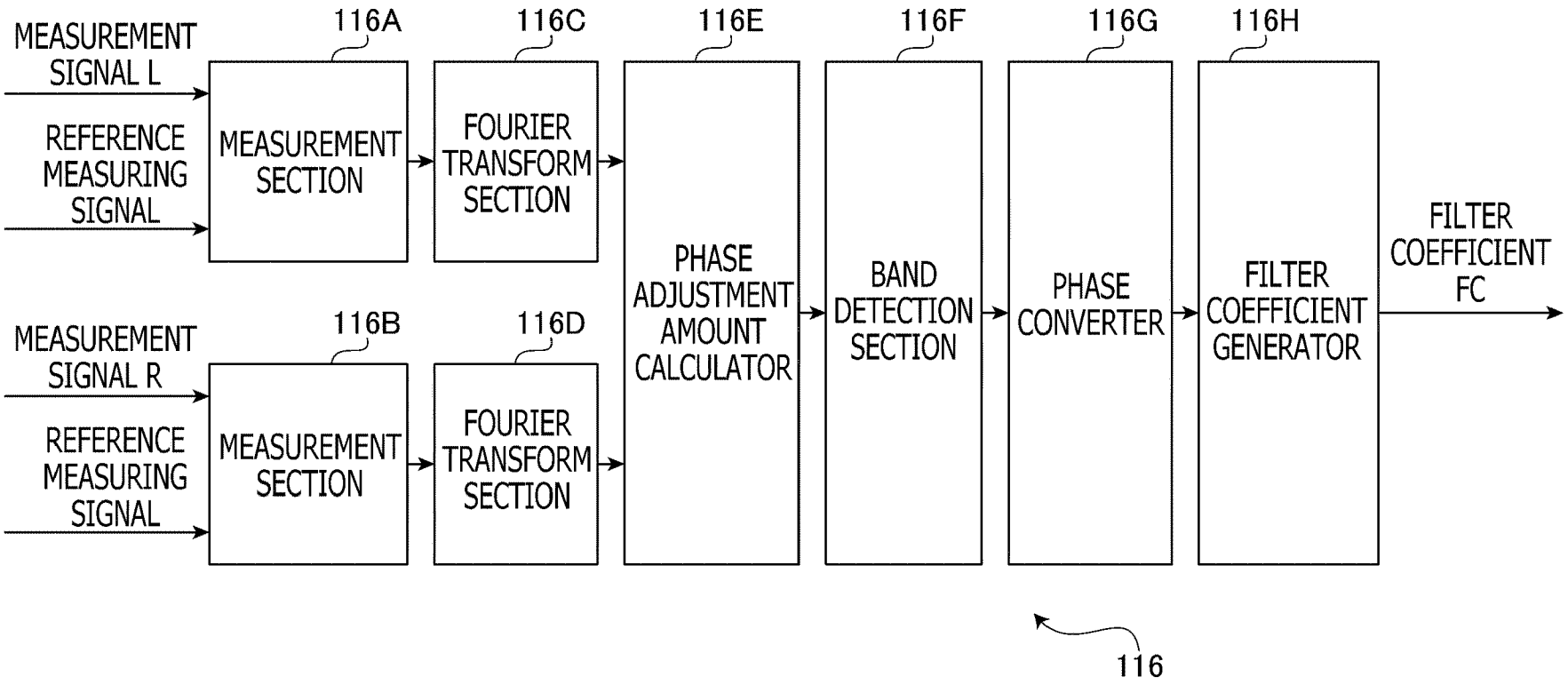
FIG. 4 is a block diagram showing a configuration of a calculator of the signal processing device.

FIG. 4 is a block diagram shown a configuration of the calculator 116. As shown in FIG. 4, the calculator 116 has measurement sections 116A and 116B.

Each of the measurement sections 116A and 116B is configured to measure an impulse response (S104).

Specifically, the measurement section 116A obtains a cross-correlation function between the measured signal of the sound for measurement from the speaker $SP_{FL}$ (hereinafter referred to as a "measured signal L") and a reference measuring signal input from the controller 100, and calculates the impulse response of the measured signal L (in other words, an impulse response between the speaker $SP_{FL}$ and the listening position; hereinafter referred to as an "impulse response Li"). The reference measuring signal is the same as the measuring signal generated by the measuring signal generator 106 and is time-synchronized with the measuring signal.

Similarly, the measurement section 116B calculates the cross-correlation function between the measured signal of the sound for measurement from the speaker $SP_{FR}$ (hereinafter referred to as a "measured signal R") and the reference measuring signal input from the controller 100, and calculates the impulse response of the measured signal R (in other words, the impulse response between the speaker $SP_{FR}$ and the listening position; hereinafter referred to as an "impulse response Ri").

Thus, the measurement sections 116A and 116B operate as measurement sections to measure the impulse responses Li and Ri between each of the plurality of speakers and the listening position based on the signals (i.e., the measured signals L and R) representing respective sounds that are output from respective speakers (speakers $SP_{FR}$ and $SP_{FL}$ in this embodiment) at timings in which the sounds do not interfere with each other at the listening position (i.e., the driver's seat in this embodiment) and are collected at the listening position.

Figure 5A:
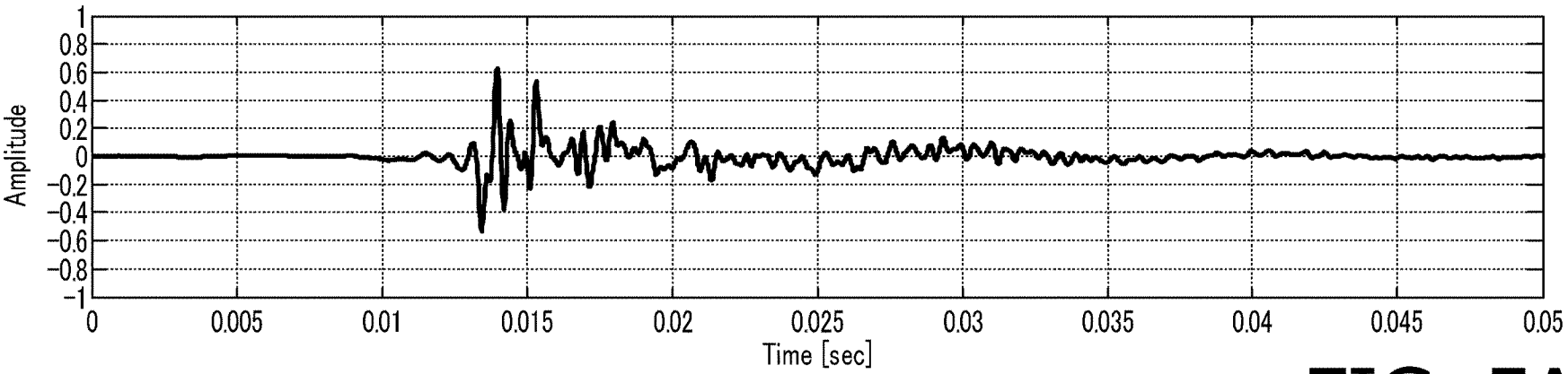
FIG. 5A shows an example of an impulse response between a left front speaker and a driver's seat.
Figure 5B:
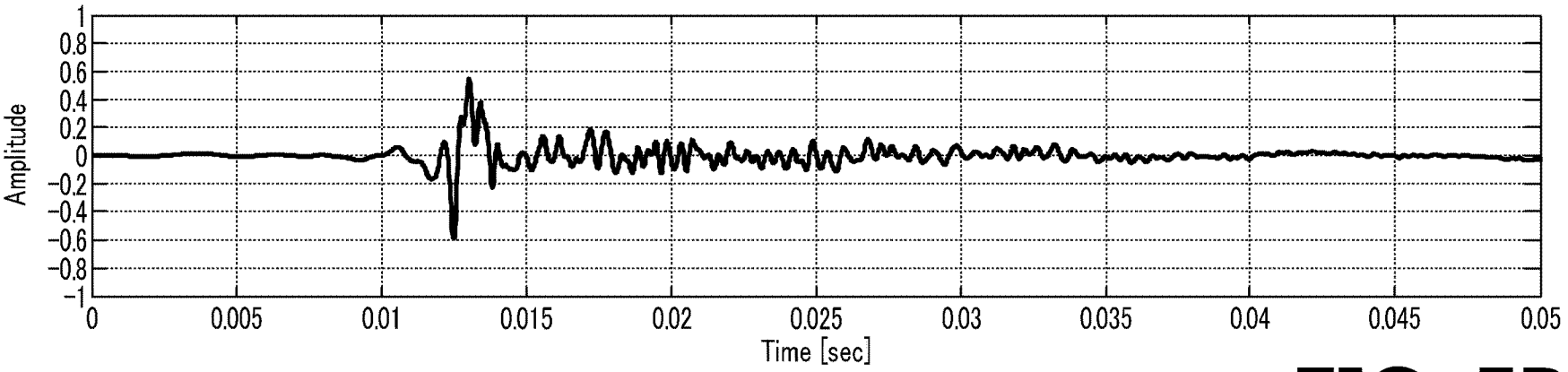
FIG. 5B shows an example of an impulse response between a right front speaker and the driver's seat.

FIG. 5A illustrates the impulse response Li and FIG. 5B illustrates the impulse response Ri. In each of FIG. 5A and FIG. 5B, the vertical axis indicates an amplitude (unitless: because of a normalized value), and the horizontal axis indicates a time (unit: sec). In the examples shown in FIG. 5A and FIG. 5B, the sampling frequency is 44.1 kHz, the code length of the M-sequence code is 32,767, and a frequency range is from 0 Hz to 22.05 kHz, which is the Nyquist frequency. It is noted that the frequency range can be set arbitrarily within the Nyquist frequency range.

As shown in FIG. 4, the calculator 116 has a Fourier transform sections 116C and 116D.

The Fourier transform section 116C is configured to apply the Fourier transform to the impulse response Li input from the measurement section 116A to obtain frequency spectrums of the impulse response Li (the frequency characteristic of amplitude and the frequency characteristic of phase; hereinafter referred to as frequency spectrums Lf) (S105). The Fourier transform section 116D is configured to apply the Fourier transform to the impulse response Ri input from the measurement section 116B to obtain the frequency spectrums of the impulse response Ri (the frequency characteristic of amplitude and the frequency characteristics of phase; hereinafter referred to as frequency spectrums Rf) (S105).

As above, the Fourier transform sections 116C and 116D are configured to obtain the frequency spectrums corresponding to respective speakers by applying the Fourier transform to the impulse responses corresponding to respective speakers.

Figure 6A:
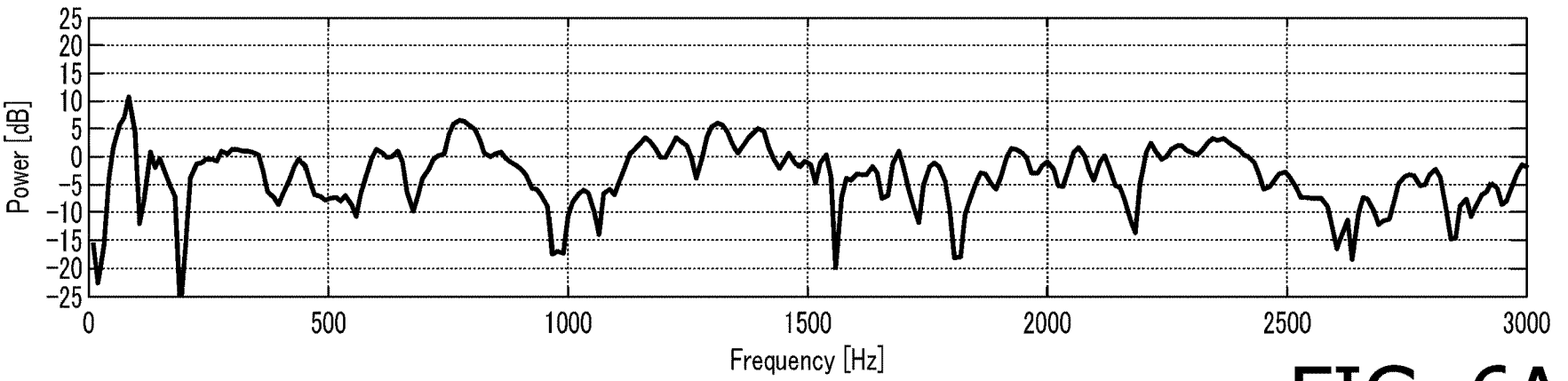
FIG. 6A shows a frequency characteristic of an amplitude obtained by applying the Fourier transform to the impulse response shown in FIG. 5A.
Figure 6B:
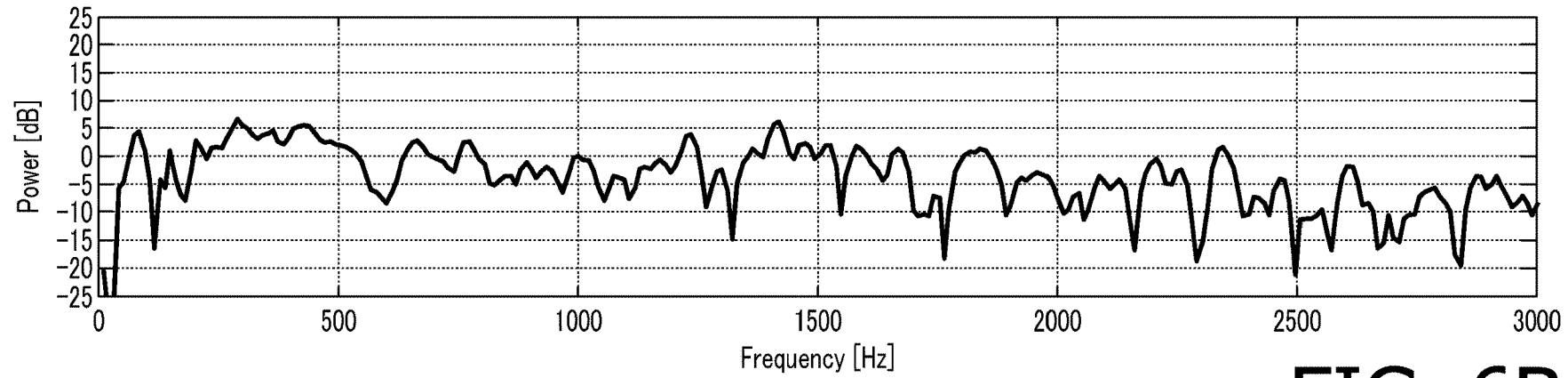
FIG. 6B shows a frequency characteristic of an amplitude obtained by applying the Fourier transform to the impulse response shown in FIG. 5B.

FIG. 6A shows a frequency characteristic of the amplitude obtained by applying the Fourier transform to the impulse response Li, and FIG. 6B shows a frequency characteristic of the amplitude obtained by applying the Fourier transform to the impulse response Ri. In each of FIGS. 6A and 6B, the vertical axis indicates a power (i.e., a sound pressure level) (unit: dB), and the horizontal axis indicates a frequency (unit: Hz).

Figure 7A:
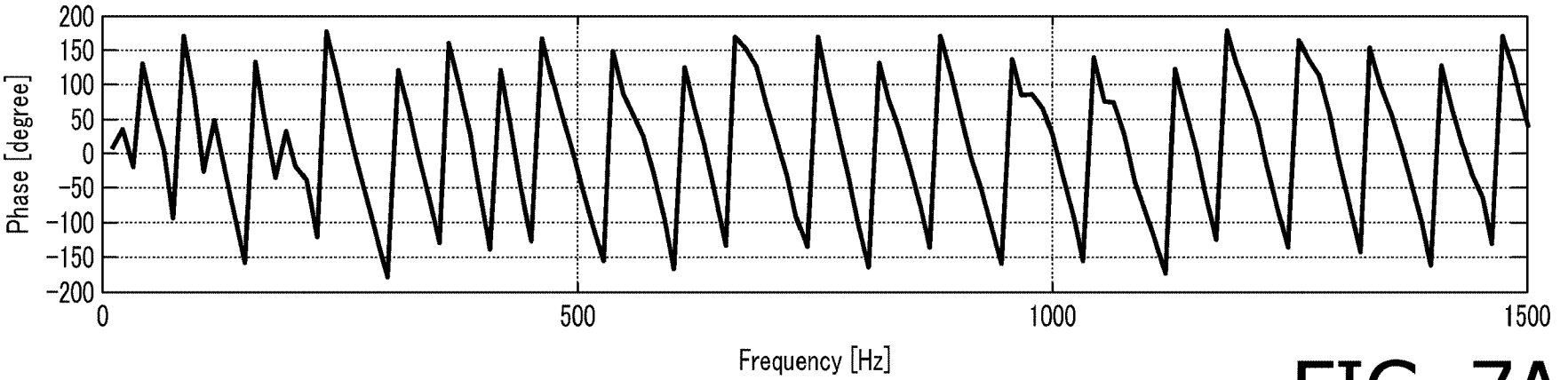
FIG. 7A shows a frequency characteristic of a phase obtained by applying the Fourier transform to the impulse response shown in FIG. 5A.
Figure 7B:
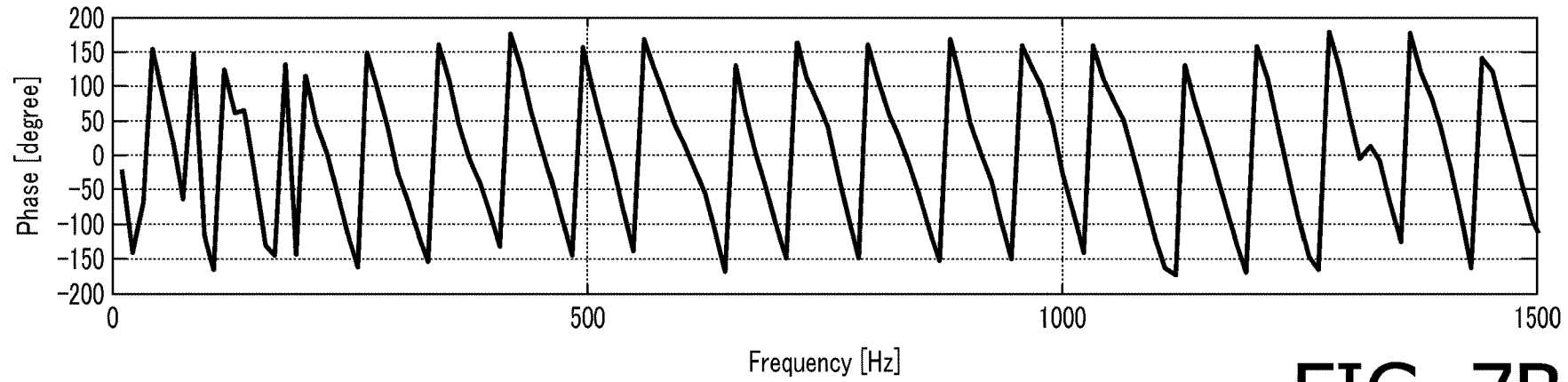
FIG. 7B shows a frequency characteristic of the phase obtained by applying the Fourier transform to the impulse response shown in FIG. 5B.

FIG. 7A shows a frequency characteristic of the phase obtained by applying the Fourier transform to the impulse response Li, and FIG. 7B shows a frequency characteristic of the phase obtained by applying the Fourier transform to the impulse response Ri. In each of FIGS. 7A and 7B, the vertical axis indicates an phase angle (unit: degree) and the horizontal axis indicates a frequency (unit: Hz).

In the examples of FIGS. 6A, 6B, 7A and 7B, the Fourier transform length is 4,096 samples. The number of frequency points is set to 2,097 points, which is the frequency range from 0 Hz to 22.05 kHz (which is the Nyquist frequency), divided into 10.5 Hz increments. Since sound is reflected, shielded, interfered, etc. in the vehicle interior, the amplitude fluctuates greatly depending on the frequency in the examples shown in FIGS. 6A and 6B, and the phase fluctuates greatly depending on the frequency in the examples shown in FIGS. 7A and 7B.

As shown in FIG. 4, the calculator 116 has a phase adjustment amount calculator 116E.

The phase adjustment amount calculator 116E is configured to calculate a phase adjustment amount for each frequency (in this embodiment, for each frequency point) of the sound signal input to a target speaker for which the phase of the sound signal is controlled based on the frequency spectrums Rf and Lf respectively corresponding to the speakers $SP_{FR}$ and $SP_{FL}$. It is noted that filter coefficients generated by the filter coefficient generation process shown in FIG. 3 are coefficients to control the phase of the sound signal input to the target speaker to be the lagging phase. The sound signal input to the target speaker is subjected to a delay according to the filter coefficient. According to the present embodiment, the speaker $SP_{FR}$ closest to the driver's seat (i.e., the listening position) where the microphone MIC is arranged (in other words, the speaker $SP_{FR}$ with the fastest sound arrival time to the driver's seat) is used as the target speaker to be controlled.

Specifically, the phase adjustment amount calculator 116E shifts (changes) the phase of the frequency spectrum Rf corresponding to the target speaker $SP_{FR}$ sequentially in the range of −180 to +180 degrees in predetermined angular increments (e.g., 1-degree increments), and synthesizes the frequency spectrum Rf after the phase shift with the frequency spectrum Lf (i.e., the frequency spectrum Lf as it is without phase shift) is synthesized at every phase shift (S106). This synthesis of the frequency spectrums means a synthesis of complex spectrums each containing amplitude and phase information. This synthesis process is performed not for all frequency points (2,097 points), but for a total of 88 frequency points included in the frequency range from 50 Hz to 1 kHz, for example, to reduce the processing load.

For example, a case where the amplitude and the phase of the frequency spectrum Lf at the frequency point of 200 Hz are 1 and 0 degrees, respectively, and the amplitude and the phase of the frequency spectrum Rf at the frequency point of 200 Hz is 1 and 180 degrees, respectively, will be considered. When there is no phase shift of the frequency spectrum Rf, the amplitude of the synthesized spectrum will be zero because the spectrums cancel each other due to their opposite phases. When the phase of the frequency spectrum Rf is shifted by +180 degrees, the amplitude of the synthesized spectrums will be 2 since the phase spectrums are in-phase (i.e., the phase is 0 degrees in the frequency spectrum Lf and 360 degrees in the frequency spectrum Rf; 360-degree phase shift means one rotation). As described above, the synthesized value varies depending on the shift angle of the phase of the frequency spectrum Rf.

Figure 8:
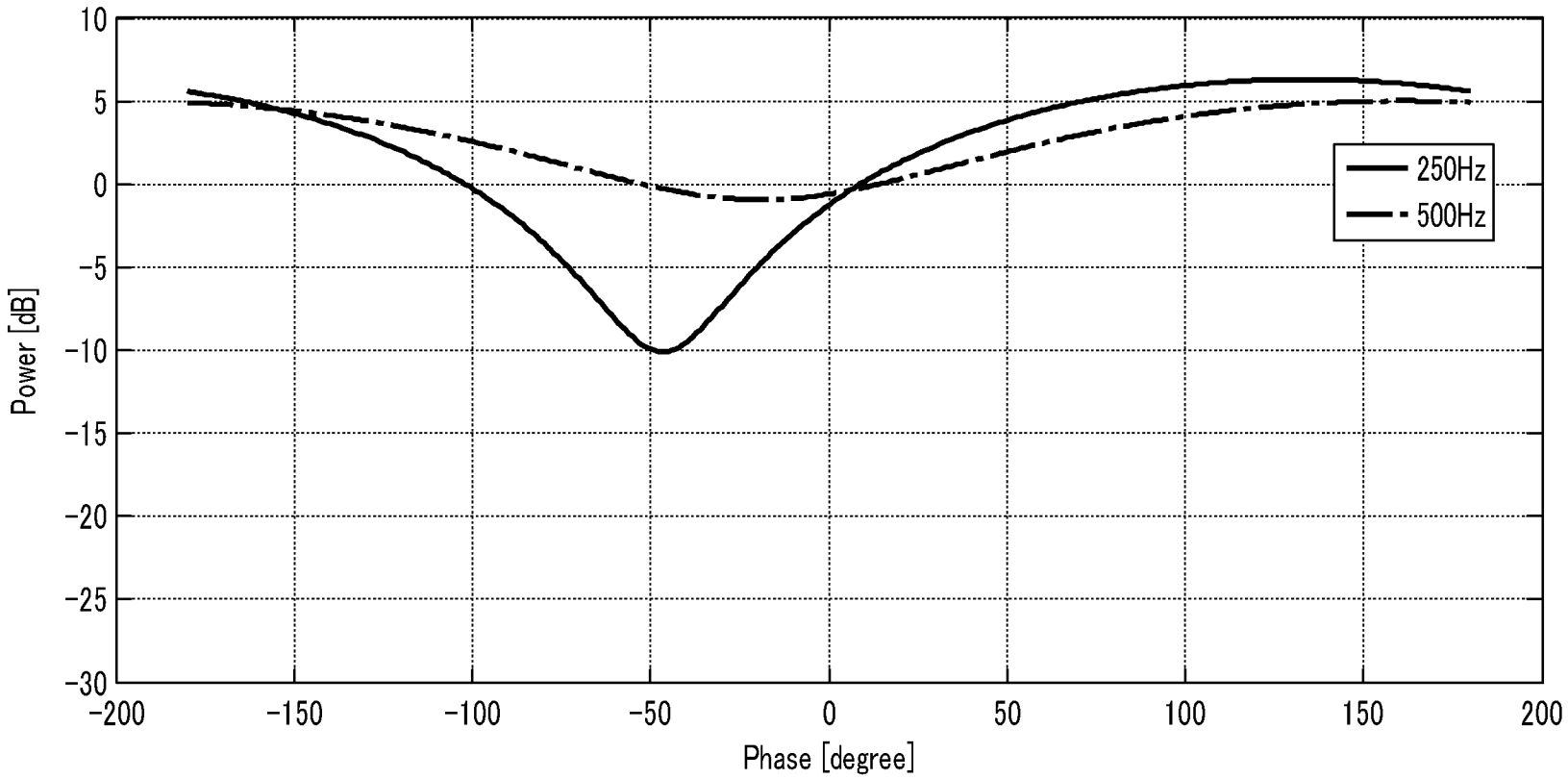
FIG. 8 shows a result of a synthesis process performed in the filter coefficient generation process shown in FIG. 3.

FIG. 8 shows the results of the synthesis process at two frequency points (i.e., at 250 Hz: solid line; and 500 Hz; single-dotted line) among the 88 frequency points. In FIG. 8, the vertical axis indicates a power (unit: dB) of the synthesized signal, and the horizontal axis indicates a phase (in this case, the shift angle of the phase of the frequency spectrum Rf) (unit: degree). The power on the vertical axis in FIG. 8 shows the amplitude after synthesis in terms of sound pressure level. It is noted that the power at zero degrees of phase (i.e., zero phase shift of the frequency spectrum Rf) indicates the power when the frequency spectrum Rf and the frequency spectrum Lf are synthesized without shifting the phase of the frequency spectrum Rf.

The synthesis process at the frequency point of 250 Hz is a process of shifting the frequency spectrum Rf in the range of −180 to +180 degrees in predetermined angular increments, and synthesizing the frequency spectrum Rf at the frequency point of 250 Hz after the phase shift with the frequency spectrum Lf at the frequency point of 250 Hz at every execution of the phase shift. By connecting the synthesized values each obtained when the phase of the frequency spectrum Rf is shifted with a smooth curve (for example, an approximate curve by the least-square method or polynomial equation), a result shown by the solid line in FIG. 8 is obtained.

The synthesis process at the frequency point of 500 Hz is a process of shifting the frequency spectrum Rf in the range of −180 to +180 degrees in predetermined angular increments, and synthesizing the frequency spectrum Rf at the frequency point of 500 Hz after the phase shift with the frequency spectrum Lf at the frequency point of 500 Hz at every execution of the phase shift. By connecting the synthesized values each obtained when the phase of the frequency spectrum Rf is shifted with a smooth curve (for example, an approximate curve by the least-square method or polynomial equation), a result shown by the single-dotted line in FIG. 8 is obtained.

In FIG. 8, when the phase of the sound signal input to the speaker $SP_{FR}$ is shifted by an angle so that the power is maximized, the phase of the sound from the speaker $SP_{FR}$ and the phase of the sound from the speaker $SP_{FL}$ become substantially in-phase at the listening position (i.e., the sounds from the speakers interfere with each other most strongly at the listening position). When the phase of the sound signal input to the speaker $SP_{FR}$ is shifted by an angle so that the power is minimized, the phase of the sound from the speaker $SP_{FR}$ and the phase of the sound from the speaker $SP_{FL}$ are substantially opposite at the listening position (i.e., the sounds from the speakers interfere with each other most weakly at the listening position).

In the case of the frequency point of 250 Hz, when the phase of the sound signal input to the speaker $SP_{FR}$ is shifted by +135 degrees, the phase of the sound from the speaker $SP_{FR}$ and the phase of the sound from the speaker $SP_{FL}$ become substantially in-phase at the listening position, while when the phase of the sound signal input to the speaker $SP_{FR}$ is shifted by −45 degrees, the phase of the sound from the speaker $SP_{FR}$ and the phase of the sound from the speaker $SP_{FL}$ become substantially opposite at the listening position.

In the case of the frequency point of 500 Hz, when the phase of the sound signal input to the speaker $SP_{FR}$ is shifted by +160 degrees, the phase of the sound from the speaker $SP_{FR}$ and the phase of the sound from the speaker $SP_{FL}$ become substantially in-phase at the listening position, while when the phase of the sound signal input to the speaker $SP_{FR}$ is shifted by −20 degrees, the phase of the sound from the speaker $SP_{FR}$ and the phase of the sound from the speaker $SP_{FL}$ become substantially opposite at the listening position.

The phase adjustment amount calculator 116E calculates the value of the phase shift (hereinafter, referred to as a "phase adjustment amount") of the frequency spectrum Rf at each frequency point to make the phase of the sound from the speaker $SP_{FR}$ and the phase of the sound from the speaker $SP_{FL}$ substantially in-phase at the listening position (S107).

In the present embodiment, in order to increase the sound pressure at the listening position, the phase adjustment amount of the frequency spectrum Rf at each frequency point necessary for making the phase of the sound from the speaker $SP_{FR}$ and the phase of the sound from the speaker $SP_{FL}$ substantially in-phase at the listening position is obtained.

Figure 9:
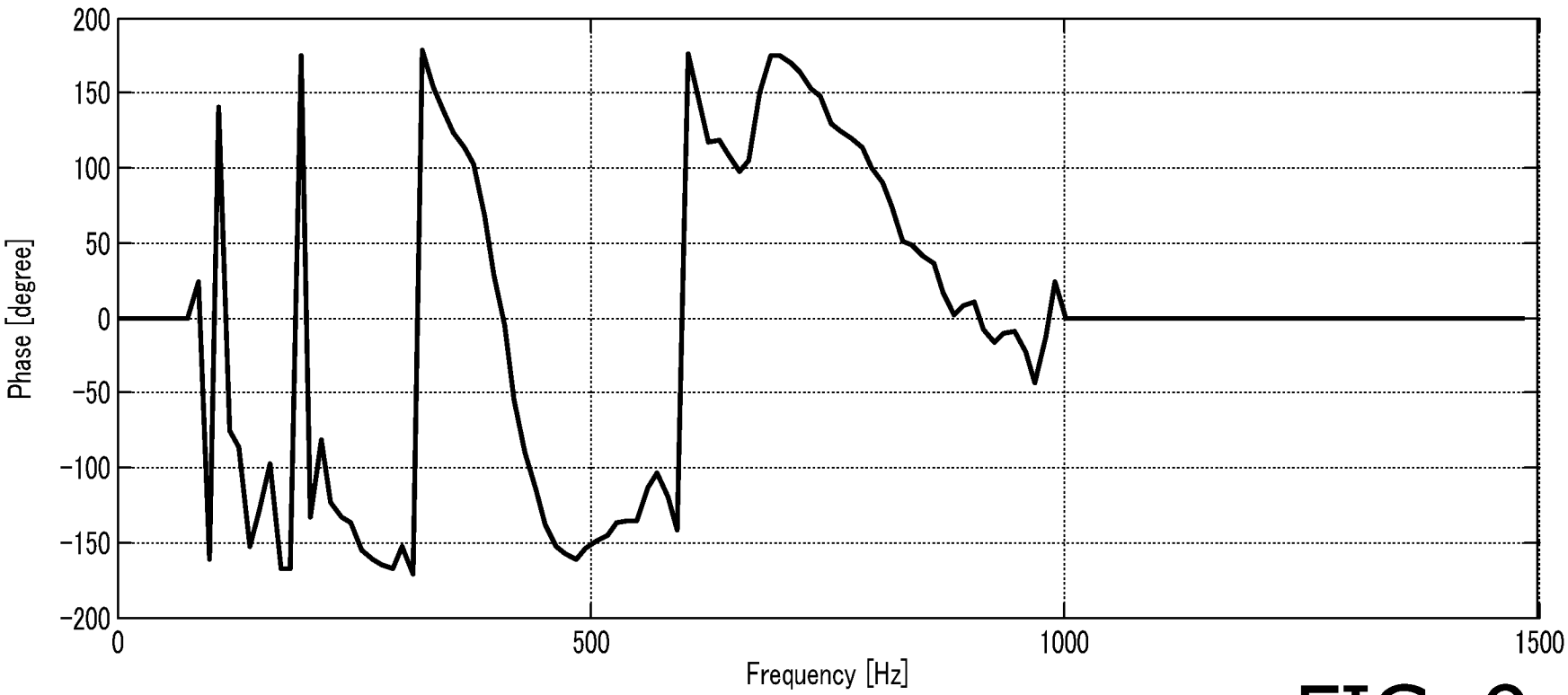
FIG. 9 shows phase adjustment amounts at each frequency point when phases of the sounds from respective speakers are substantially in-phase at the driver's seat.

FIG. 9 shows the phase adjustment amount at each frequency point in the frequency spectrum Rf in the range of 50 Hz to 1 kHz to make the phase of the sound from speaker $SP_{FR}$ and the phase of the sound from speaker $SP_{FL}$ substantially in-phase at the listening position. In FIG. 9, the vertical axis indicates the phase adjustment amount (unit: degree), and the horizontal axis indicates the frequency (unit: Hz). It is noted that FIG. 9 shows the phase adjustment amount in the frequency domain of the frequency spectrum Rf as the phase adjustment amounts of adjacent frequency points along the frequency axis are connected with lines.

It is noted that the phase adjustment amounts differ greatly depending on the frequency due to the difference in propagation delay time at each frequency, which is caused by reflection, shield, interference, etc. of sounds in the vehicle interior, as shown in FIG. 9.

As shown in FIG. 4, the calculator 116 has a band detection section 116F. The band detection section 116F is configured to detect the band having a leading phase based on the phase adjustment amount, which is calculated by the phase adjustment amount calculator 116E, at each frequency (in the present embodiment, at each frequency point) of the frequency spectrum Rf.

Specifically, the band detection section 116F allocates the phase adjustment amounts (see FIG. 9) for respective frequency points of the frequency spectrum Rf calculated by the phase adjustment amount calculator 116E into phase adjustment amounts greater than 0 (i.e., a positive phase adjustment amounts) and phase adjustment amounts less than 0 (i.e., a negative phase adjustment amounts) (S108). In this embodiment, when the phase adjustment amount equal to zero is allocated to the positive phase adjustment.

The band detection section 116F converts the phase adjustment amounts allocated to be negative in step S108 to absolute values, i.e., converts the negative phase adjustment amounts to positive phase adjustment amounts (S109). According to the present embodiment, in order to facilitate a threshold judgment in step S112 described below, the negative phase adjustment amounts are converted into the positive phase adjustment amounts (S109). That is, in order to easily perform a threshold determination in S112 (described later) (specifically, for example, in order to determine that the phase adjustment amount is less than the threshold value when the phase adjustment amount is greater than −90 degrees and less than +90 degrees, and determine that the phase adjustment amount is greater than the threshold value when the phase adjustment amount is less than −90 degrees or greater than +90 degrees), the negative phase adjustment amounts are converted into the positive phase adjustment amounts (S109).

Figure 10:
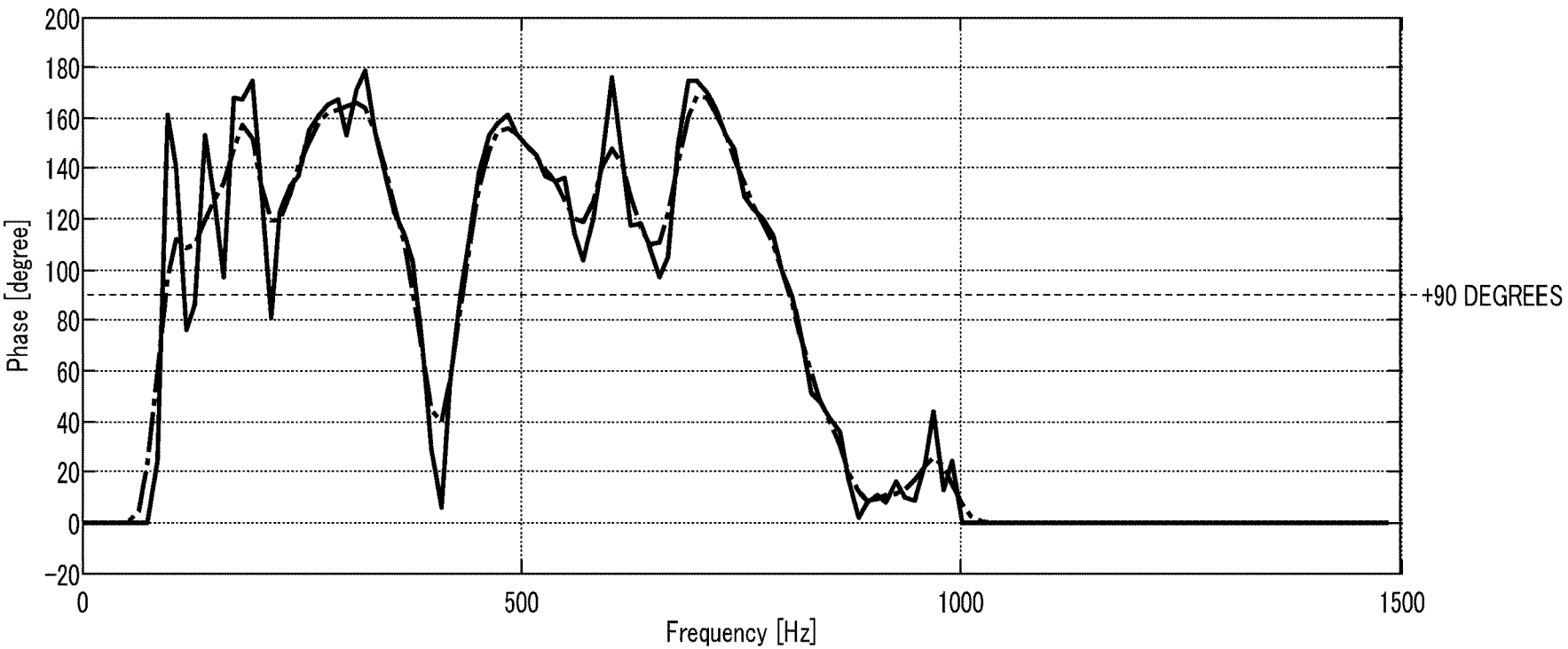
FIG. 10 shows the phase adjustment amount after the synthesis and the phase adjustment amount after smoothing performed in the filter coefficient generation process shown in FIG. 3.

The band detection section 116F synthesizes the positive phase adjustment amounts allocated in S108 and the phase adjustment amounts converted from negative to positive (i.e., the phase adjustment amounts converted to absolute value) in S109 (S110). FIG. 10 shows the phase adjustment amounts after the synthesis by step S110 in solid lines. In FIG. 10, the vertical axis indicates the phase adjustment amount (unit: degree), and the horizontal axis indicates the frequency (unit: Hz). The solid line in FIG. 10 is a graph which connecting the phase adjustment amounts of respective adjacent frequency points on the frequency axis with lines. The solid line in FIG. 10 indicates the phase adjustment amounts after synthesis in step S110, and indicates the phase adjustment amounts in the frequency domain.

The band detection section 116F performs smoothing of the phase adjustment amounts of respective frequency points after synthesis in step S110 along the frequency axis (S111). The smoothing is, for example, a process to remove noise and singularities from a graph. In this embodiments, the smoothing is performed using, for example, a low-pass filter with an FIR of 8 taps. FIG. 10 shows the phase adjustment amounts in the frequency domain after the smoothing in step S111 with single-dotted lines.

The band detection section 116F detects bands having leading phases, or in other words, the bands that cause pre-echoes, using a predetermined threshold (S112). Specifically, the band detection section 116F detects the bands each including the frequency point at which the phase adjustment amount is +90 degrees or more among the frequency points after smoothing in step S111 as the bands that has the leading phases. The bands detected in step S112 will be hereinafter referred to as the "leading phase bands."

In step S112, since first and second lagging phase data described below are data that control the phase at an interval of 180 degrees, the threshold is set to +90 degrees, which is half the value of 180 degrees. It is noted, however, this threshold (i.e., +90 degrees) is only one example, and may be another value, such as +45 degrees or +135 degrees, for example.

As shown in FIG. 4, the calculator 116 has the phase converter 116G. The phase converter 116G is configured to convert a phase of the leading phase band detected by the band detection section 116F to the lagging phase.

Figure 11:
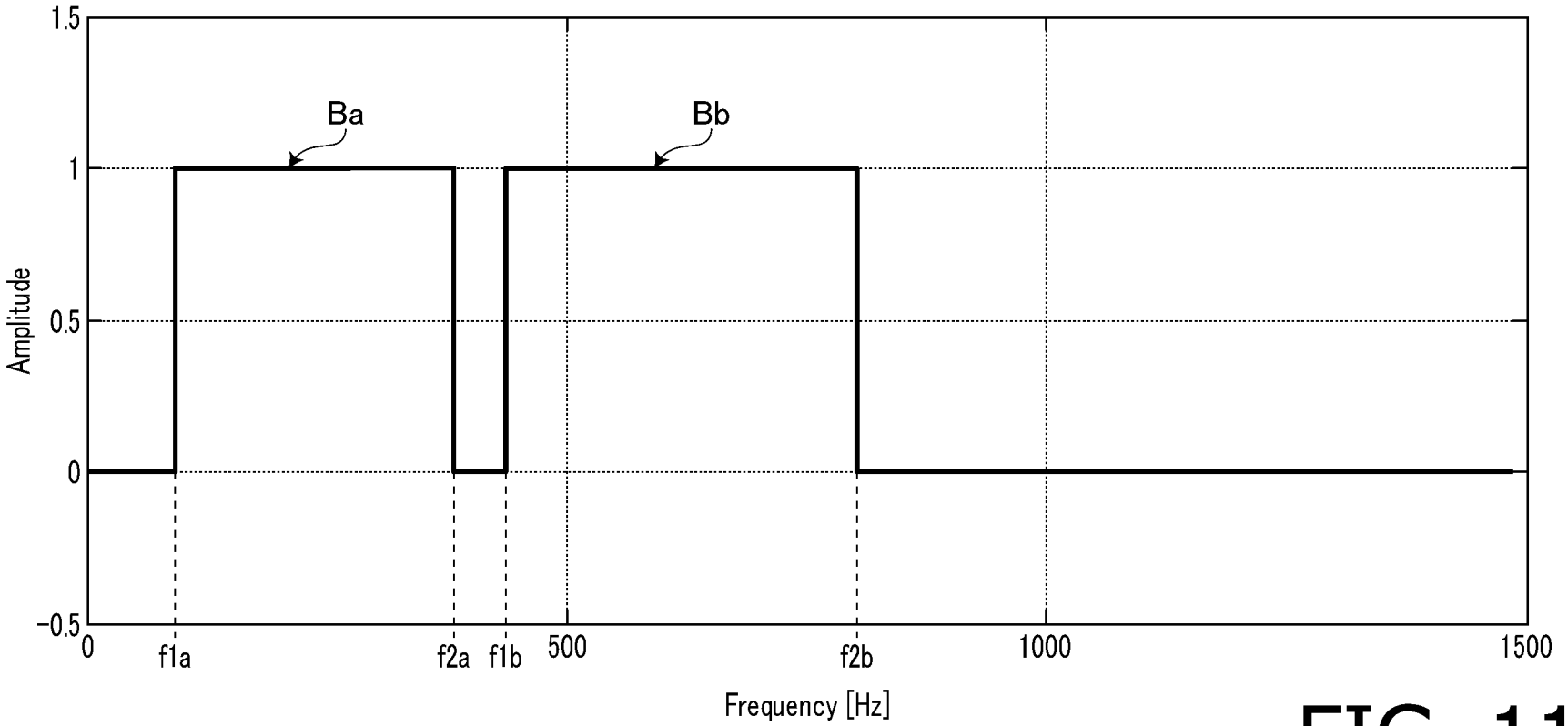
FIG. 11 shows the result of setting the values by a phase converter provided to the calculator in the filter coefficient generation process shown in FIG. 3.

Specifically, the phase converter 116G generates data in which a value (i.e., amplitude) of 1 is set to the leading phase bands detected in S112, and a value of 0 is set to the other frequency bands (i.e., the frequency bands in each of which the phase adjustment amount is less than +90 degrees) (S113). FIG. 11 shows a result of setting values (i.e., the generated data) in S113. In FIG. 11, the vertical axis indicates a set value and the horizontal axis indicates the frequency (unit: Hz).

In the present embodiment, two leading phase bands are detected. Of the two leading phase bands shown in FIG. 11, a leading phase band with the lower frequency band is referred to as a "leading phase band Ba," and a leading phase band with a higher frequency band is referred to as a "leading phase band Bb." The frequency of a rising part of the leading phase band Ba (in other words, a starting frequency of the leading phase band Ba) is referred to as "frequency fla," and a frequency of a falling part of the leading phase band Ba (in other words, an ending frequency of the leading phase band Ba) is referred to as "frequency f2a." Similarly, a frequency of a rising part of the leading phase band Bb (i.e., a starting frequency of the leading phase band Bb) is referred to as "frequency flb," and a frequency of a falling part of the leading phase band Bb (i.e., an ending frequency of the leading phase band Bb) is referred to as "frequency f2b."

In the setting result shown in FIG. 11, the phase converter 116G generates first lagging phase data in which the phase is shifted to a negative side by a predetermined angle every time the value on the frequency axis changes from 0 to 1 (i.e., every time when the rising part of the leading phase band (the starting frequency of the leading phase band) appears in the frequency domain when moving toward a larger frequency along the frequency axis), and generates second lagging phase data in which the phase is shifted to the negative side by a predetermined angle every time the value on the frequency axis changes from 1 to 0 (i.e., every time when the falling part of the leading phase band (the end frequency of the leading phase band) appears in the frequency domain when moving toward a larger frequency along the frequency axis) (S114). In this embodiment, the above predetermined angle is −180 degrees. Thus, the phase converter 116G generates the lagging phase data (i.e., first lagging phase data and second lagging phase data) in which the phases of the leading phase bands Ba and Bb are converted to negative phases.

Figure 12:
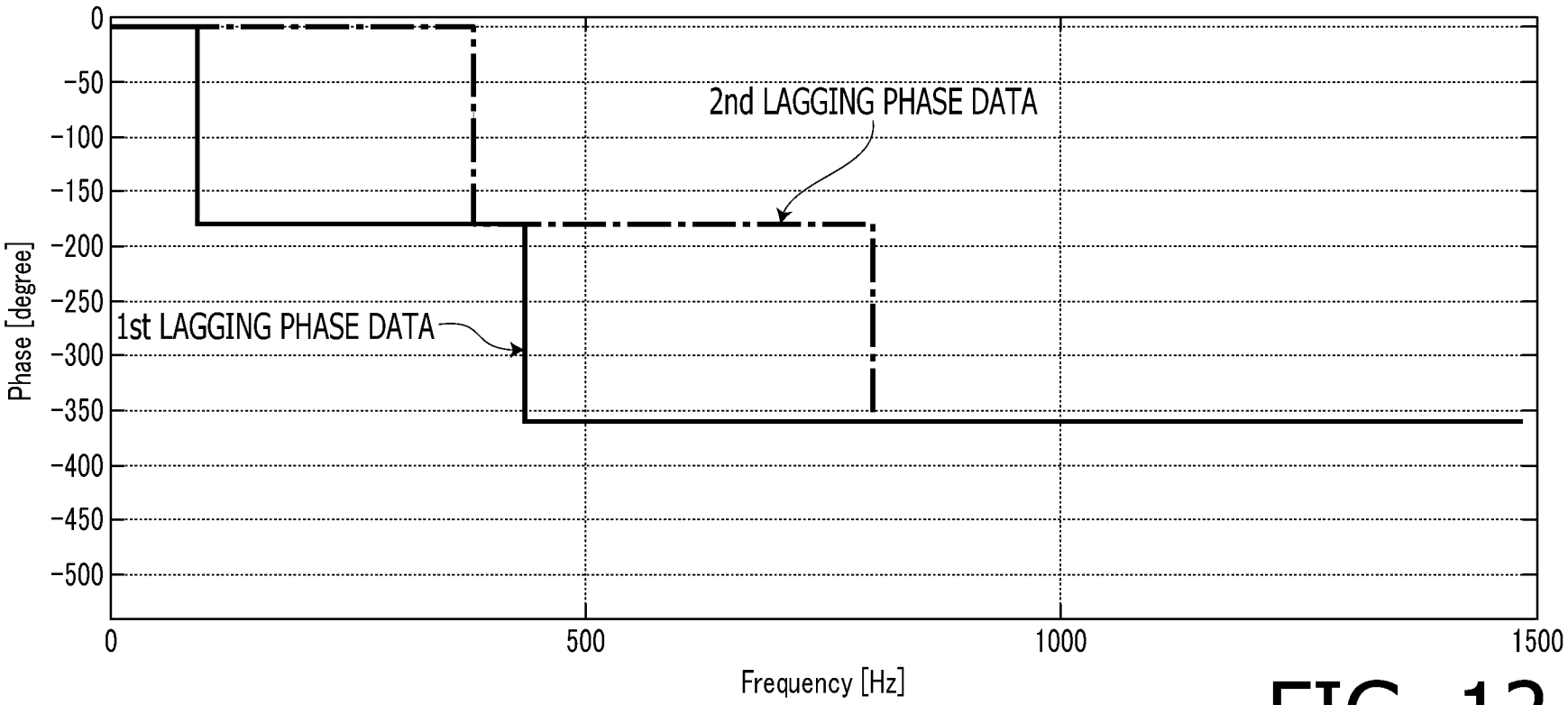
FIG. 12 shows first and second lagging phase data generated by the phase converter.

FIG. 12 shows the first and second lagging phase data generated by the phase converter 116G. In FIG. 12, the solid lines indicate the first lagging phase data and the single-dotted lines indicate the second lagging phase data. In FIG. 12, the vertical axis indicates a phase adjustment amount (unit: degree), and the horizontal axis indicates the frequency (unit: Hz).

As shown in FIG. 12, the first lagging phase data is configured such that the phase shifts by −180 degrees at frequency f1a and further shifts by −180 degrees at frequency f1b. The second lagging phase data is configured such that the phase shifts by −180 degrees at frequency f2a and further shifts by −180 degrees at frequency f2b.

In the present embodiment, since the two leading phase bands are detected in step S112, there are two areas, along the frequency axis, where the value changes from 0 to 1 (see frequencies f1a and f1b in FIG. 11), and two areas, along the frequency axis, where the value changes from 1 to 0 (see frequencies f2a and f2b in FIG. 11). Every time when these portions appear, the phase shifts by −180 degrees, and therefore, each of the first and second lagging phase data has a maximum lagging phase of 360 degrees.

It is considered herein a case where no smoothing is performed in step S111. In such a case, the band detection section 116F detects the leading phase bands based on the phase adjustment amount at each frequency point after synthesis in S110. In this case, there are a total of four leading phase bands to be detected. Therefore, the first and second lagging phase data generated in S114 will be data having a lagging phase of at most 720 degrees. The larger the lagging phase of the lagging phase data is, the better the effect of reducing the pre-echo is. However, too much delay in the phase deteriorates the accuracy of the compensation of the frequency characteristics of the sound signals using the FIR filter and reduces the effect of improving the sound pressure and/or sound quality. In addition, the larger the lagging phase is, the steeper the phase change along the frequency axis becomes, and the more likely it is that abnormal sounds will be generated. Therefore, according to the present embodiment, the smoothing is performed in S111 to reduce the number of the leading phase bands to be detected in S112 so that the first and second lagging phase data do not have an excessive lagging phase.

Figure 13:
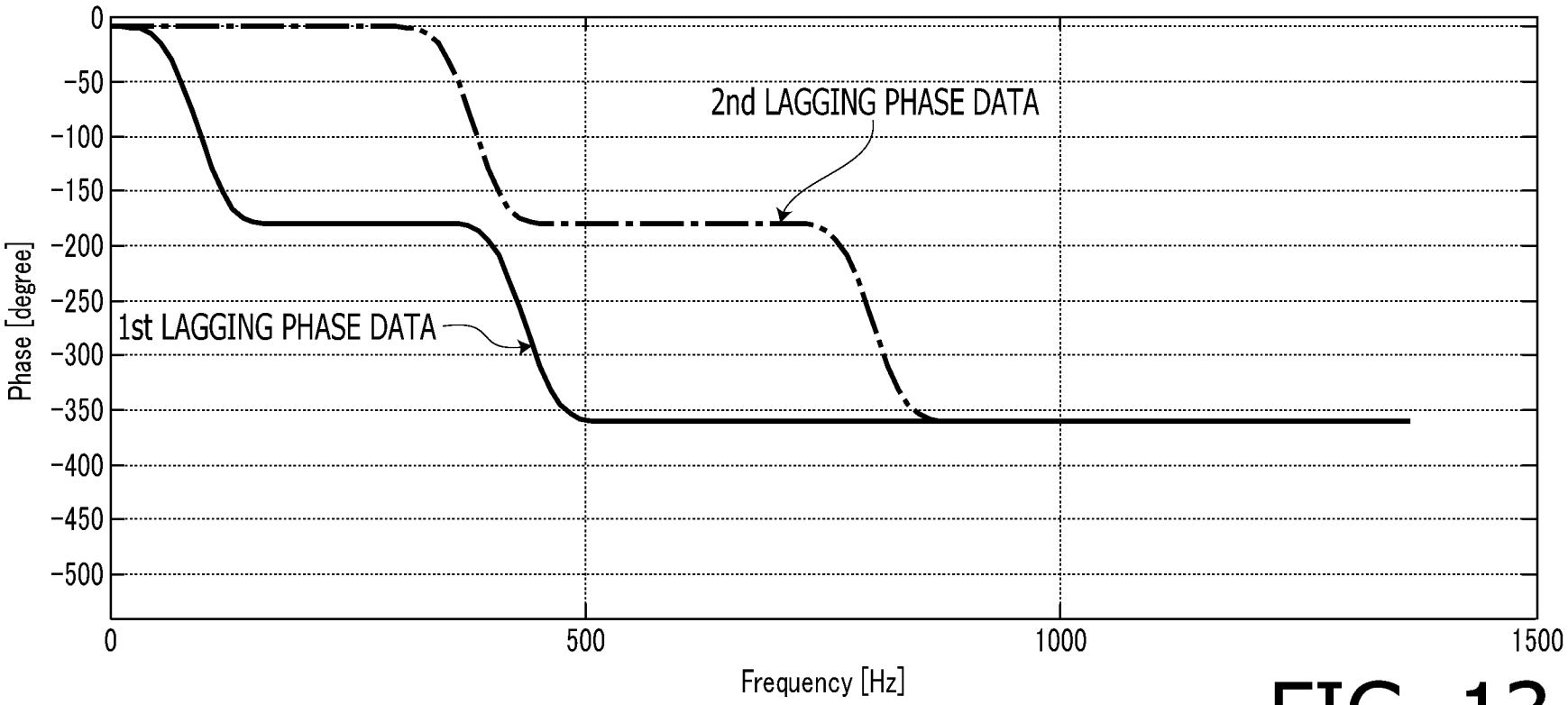
FIG. 13 shows the first and second lagging phase data after smoothing is performed in the filter coefficient generation process shown in FIG. 3.

In this embodiment, a phase shift of −180 degrees is applied in one step (e.g., so as to continuously and smoothly change from 0 to −180 degrees) as shown in FIGS. 12 and 13, every time the rising or falling part of the leading phase band appears along the frequency axis. However, the phase shift of −180 degrees may be applied in multiple steps (e.g., from 0 to −90 degrees continuously and smoothly, and then from −90 to −180 degrees continuously and smoothly).

The above-described shift angle (i.e., −180 degrees) is only one example. The shift angle may be a different angle, such as −45 degrees or −90 degrees. The shift angles respectively corresponding to the first lagging phase data and the second lagging phase data may be different angles.

When there is a point, along the frequency axis, where the phase change is too steep, an abnormal noise may be generated easily. Therefore, the phase converter 116G is configured to apply the smoothing to the first and second lagging phase data along the frequency axis (S115). The smoothing is performed by, for example, a low-pass filter using the FIR with the tap number of 16. FIG. 13 shows the first and second lagging phase data, after the smoothing in S115, with solid lines and single-dotted lines, respectively.

As shown in FIG. 4, the calculator 116 has a filter coefficient generator 116H. The filter coefficient generator 116H operates as a generating section configured to generate filter coefficients corresponding to the target speaker $SP_{FR}$ based on the phase adjustment amounts after conversion by the phase converter 116G, i.e., based on the first and second lagging phase data.

Specifically, the filter coefficient generator 116H converts the first lagging phase data, which represents signals in the frequency domain, into an impulse response, which represents signals in the time domain, and converts the second lagging phase data, which represents signals in the frequency domain, into an impulse response, which represents signals in the time domain, by applying the inverse Fourier transform. Next, the filter coefficient generator 116H convolutes the impulse response obtained by converting the first lagging phase data and the impulse response obtained by converting the second lagging phase data to obtain the convolved impulse responses as the filter coefficients corresponding to the speaker $SP_{FR}$ (S116). In other words, the filter coefficient generator 116H generates the filter coefficients corresponding to the speaker $SP_{FR}$ by convolving the two impulse responses obtained by the inverse Fourier transform. The filter coefficients are hereinafter referred to as the "filter coefficients FC."

Next, an operation of playing back the sound signal input from the sound source using the filter coefficients FC generated by the calculator 116.

The recording medium playback unit 108 plays back sound signals $S_R$ and $S_L$ input from a sound source such as a CD or a DVD (hereinafter, also referred to as "audio signals $S_R$ and $S_L$"). The controller 100 outputs the audio signals $S_L$ and $S_R$ played back by the recording medium playback unit 108 to the FIR filter 110.

The FIR filter 110 compensates the frequency characteristics of the phases of the sound signals by convolving the filter coefficients FC generated by the calculator 116 into the audio signals to be input to the target speaker (in this embodiment, the audio signal $S_R$ to be input to the speaker $SPF_R$). Since the data, which is obtained by converting the phases of the leading phase bands into the lagging phases (i.e., the first and second lagging phase data) and further converting into the impulse response, is convolved into the audio signal $S_R$ as the filter coefficients, the sound pressure and sound quality (in the present embodiment, the sound pressure only) can be improved while reducing the pre-echo.

It is noted that the FIR filter 110 is configured to output the audio signals to be input to speakers that are not the target speakers (hereinafter, referred to as "non-target speakers") without compensating the frequency characteristic of the phase by a through output. The audio signals $S_R$ and $S_L$ output from the FIR filter 110 are output to the vehicle interior via the amplifier 112 and then the speakers $SP_{FR}$ and $SP_{FL}$, respectively. By compensating the frequency characteristics of the phase using the FIR filter 110, a music piece or the like of which sound pressure and sound quality are improved while the pre-echo being reduced is played back in the vehicle interior.

FIGS. 14A through 17B show concrete examples of the sound characteristics observed at each seating position (e.g., the driver's seat and the front passenger's seat). FIGS. 14A, 14B, 15A and 15B show examples according to the present disclosures, while FIGS. 16A, 16B, 17A and 17B show comparative examples (conventional examples). In the examples in FIGS. 14A through 17B, it is assumed that the audio signal used to observe the sound characteristics is a monaural impulse signal and the frequency range is from 50 Hz to 1 kHz.

Figure 14A:
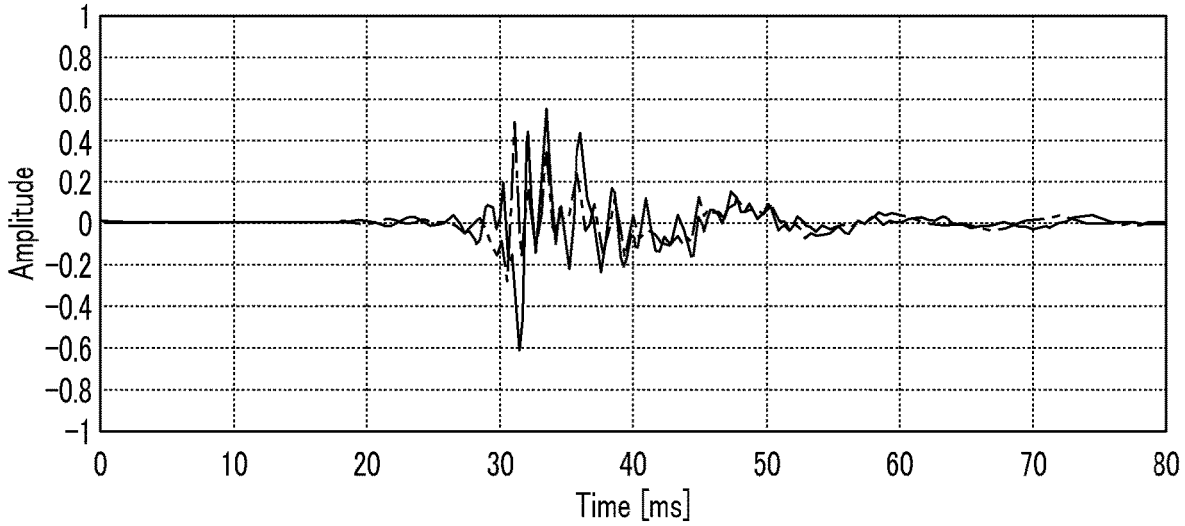
FIG. 14A shows an impulse response observed at the driver's seat when audio signals are output simultaneously from respective speakers using the filter coefficients generated by the filter coefficient generation process shown in FIG. 3.
Figure 14B:
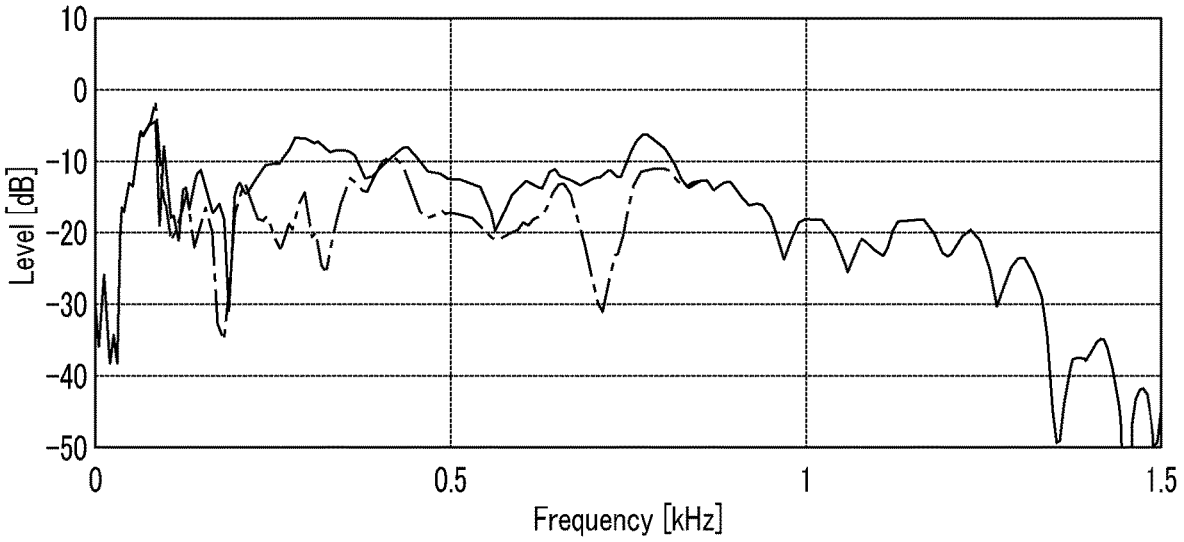
FIG. 14B shows frequency characteristics of the sound observed at the driver's seat when the audio signals are output simultaneously from respective speakers using the filter coefficients generated by the filter coefficient generation process shown in FIG. 3.

FIG. 14A shows the impulse response (i.e., the time characteristics of the sound) observed at the driver's seat when the audio signal is output simultaneously from the speakers $SP_{FR}$ and $SP_{FL}$. FIG. 14B shows the frequency characteristics of the sound observed at the driver's seat when the audio signal is output simultaneously from the speakers $SP_{FR}$ and $SP_{FL}$.

Figure 15A:
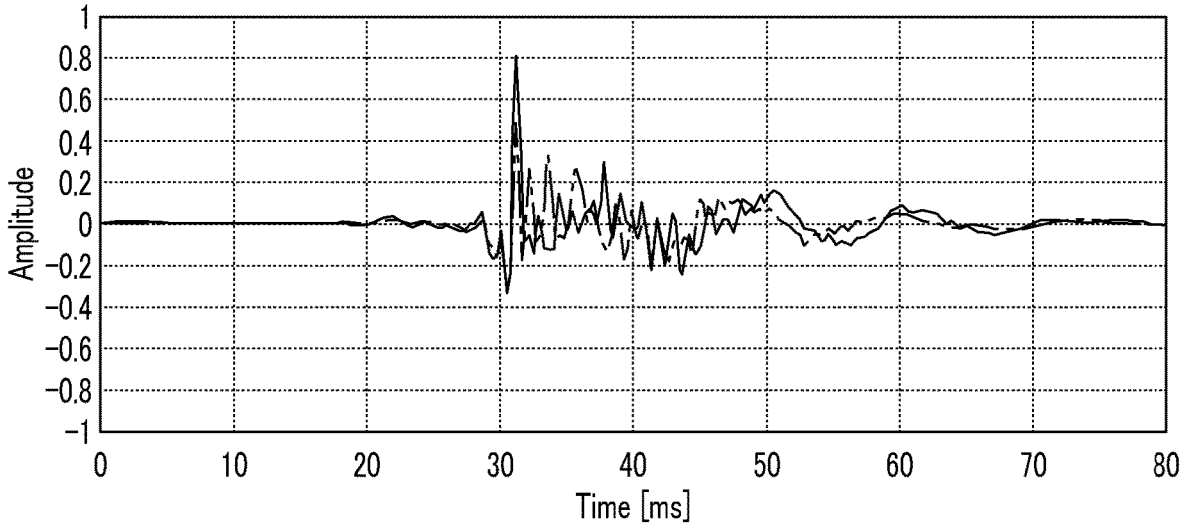
FIG. 15A shows an impulse response observed at a front passenger's seat when the audio signals are output simultaneously from respective speakers using the filter coefficients generated by the filter coefficient generation process shown in FIG. 3.
Figure 15B:
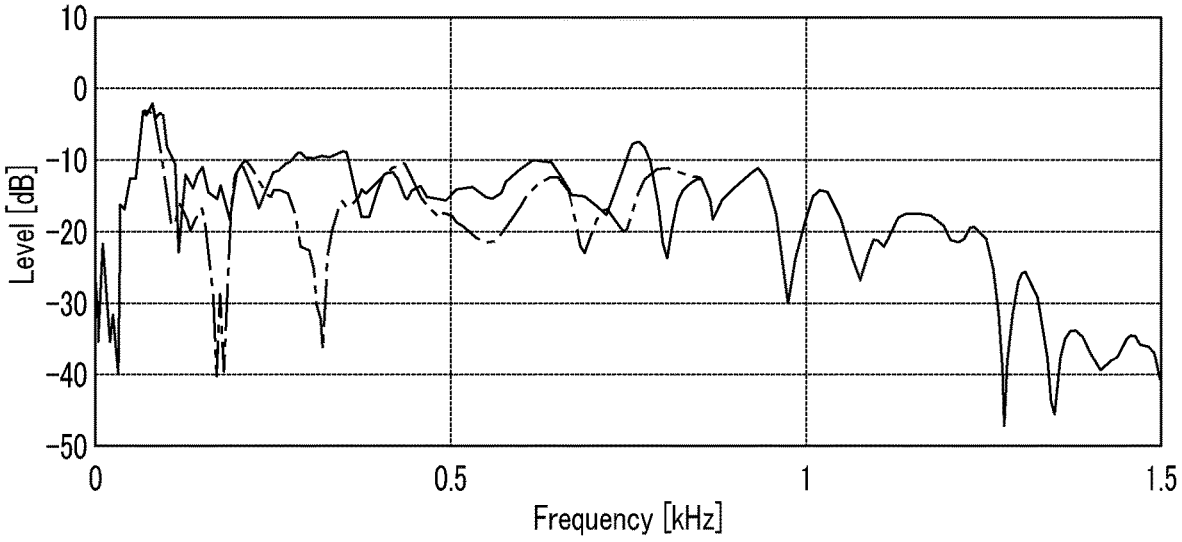
FIG. 15B shows frequency characteristics of the sound observed at the front passenger's seat when the audio signals are output simultaneously from respective speakers using the filter coefficients generated by the filter coefficient generation process shown in FIG. 3.

FIG. 15A shows the impulse response observed at the front passenger's seat when the audio signals are output simultaneously from the speakers $SP_{FR}$ and $SP_{FL}$. FIG. 15B shows the frequency characteristics of the sound observed at the front passenger seat when the audio signal is output simultaneously from each of the speakers $SP_{FR}$ and $SP_{FL}$.

In each of FIGS. 14A and 15A, the vertical axis indicates an amplitude (unitless as the values are normalized), and the horizontal axis indicates a time (unit: sec). In each of FIGS. 14B and 15B, the vertical axis indicates a sound pressure level (unit: dB), and the horizontal axis indicates the frequency (unit: Hz). In FIGS. 14A, 14B, 15A and 15B, the solid line shows the characteristics of the sound observed in the driver's seat when the filter coefficients FC generated in the filter coefficient generation process of FIG. 3 are convolved with the signal input to the speakers $SP_{FR}$ and the audio signal is output simultaneously from the speakers $SP_{FR}$ and SPim. The single-dotted lines show the characteristics of the sound observed in the driver's seat when the audio signals are output simultaneously from the speakers $SP_{FR}$ and $SP_{FL}$ without convolution of the filter coefficients FC into the signals input to the speaker $SP_{FR}$ (i.e., without the filter control by the FIR filter 110). In the example of FIGS. 14A, 14B, 15A and 15B, as in the above-described embodiment, the frequency characteristics of the phase of the audio signal $S_R$ are compensated by convolving the filter coefficients FC into the audio signal $S_R$ to be input to the target speaker $SP_{FR}$, and the frequency characteristics of the phase of the audio signal $S_L$ to be input to the non-target speaker $SP_{FL}$ are not compensated. Generally, a signal is delayed by the FIR filter 110. However, the delay of each of spectrums (i.e., amplitudes and sound pressure levels) indicated by the solid lines in FIGS. 14A-15B (i.e., the delay by the FIR filter 110) is compensated here for explaining differences between the solid lines and the single-dotted lines.

Figure 16A:
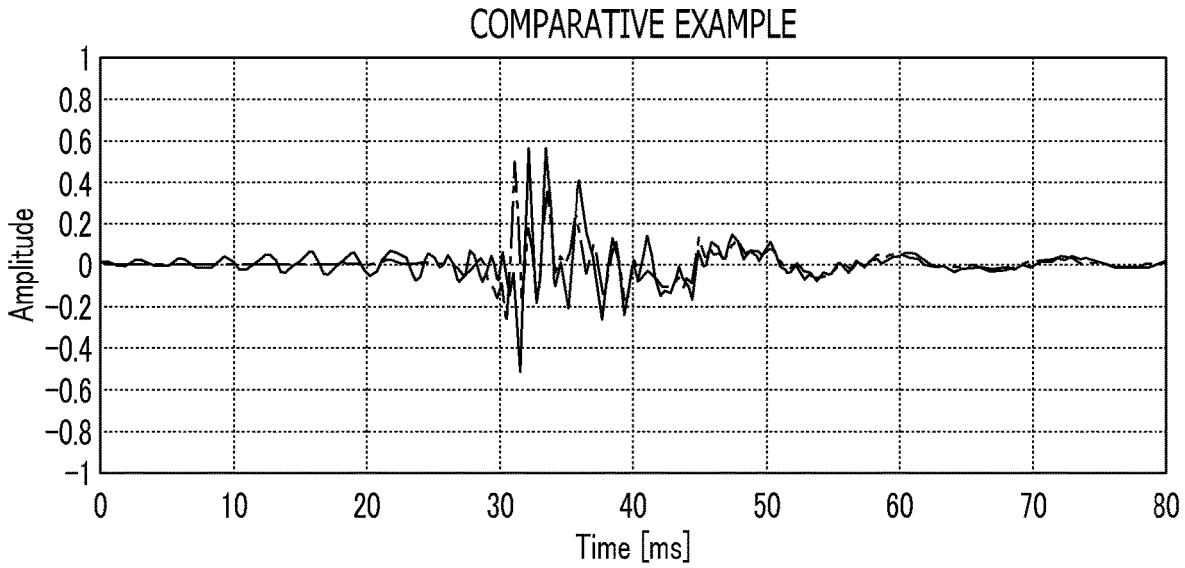
FIG. 16A shows an impulse response observed at the driver's seat when the audio signals are output simultaneously from respective speakers using conventional filter coefficients.
Figure 16B:
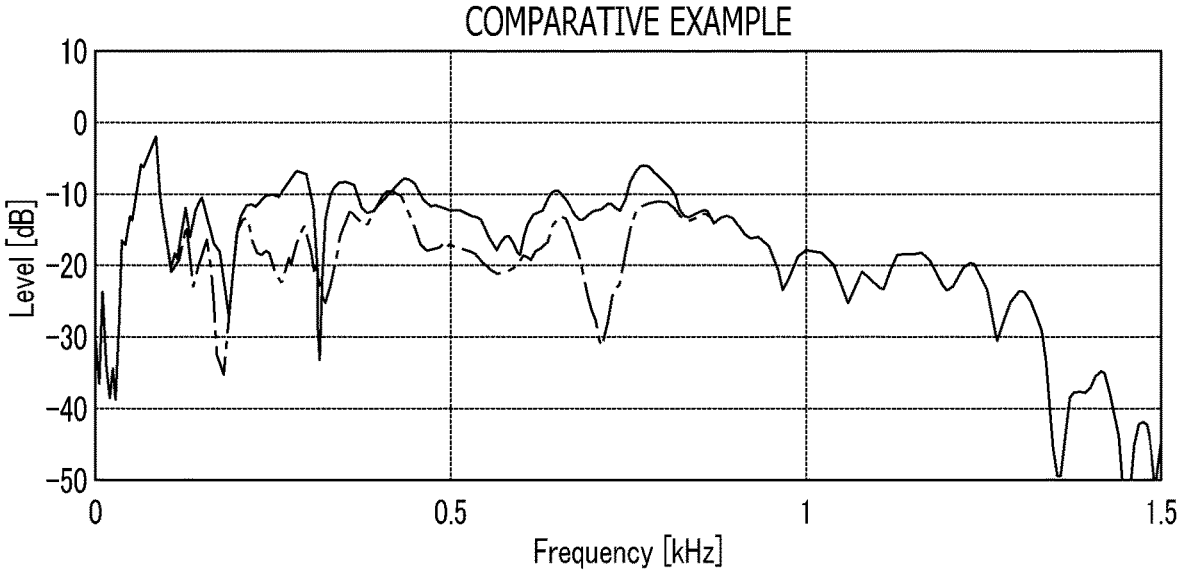
FIG. 16B shows frequency characteristics of the sound observed at the driver's seat when the audio signals are output simultaneously from respective speakers using the conventional filter coefficients.

FIG. 16A shows the impulse response observed at the driver's seat when the audio signals are output simultaneously from the speakers $SP_{FR}$ and $SP_{FL}$ in the comparative example. FIG. 16B shows the frequency characteristics of the sound observed at the driver's seat when the audio signal is output simultaneously from the speakers $SP_{FR}$ and $SP_{FL}$ in the comparative example.

Figure 17A:
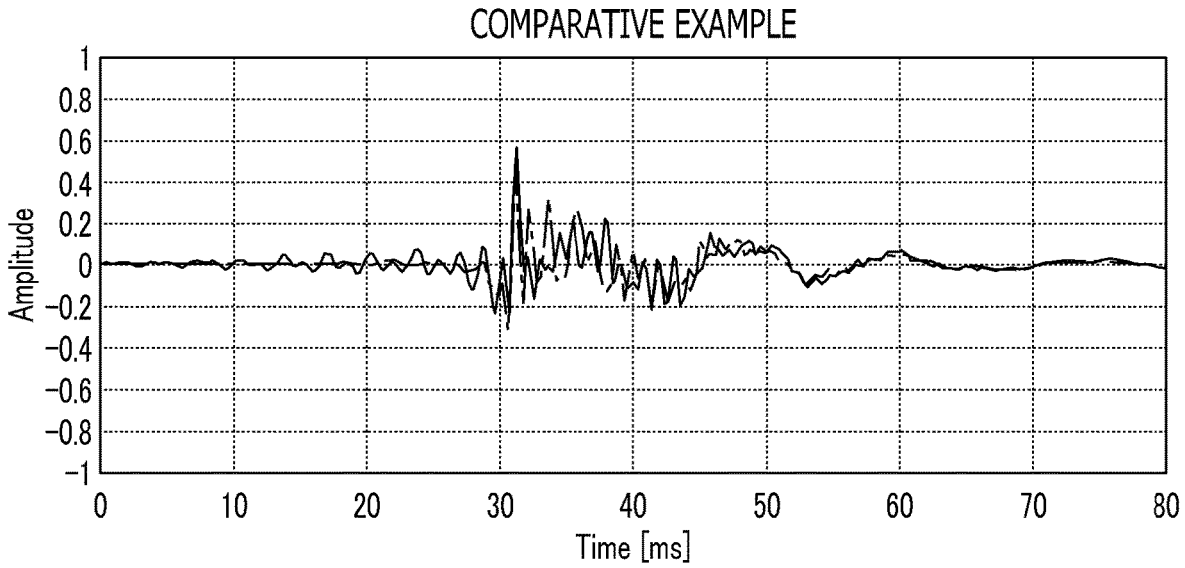
FIG. 17A shows an impulse response observed at the front passenger's seat when the audio signals are output simultaneously from respective speakers using conventional filter coefficients.
Figure 17B:
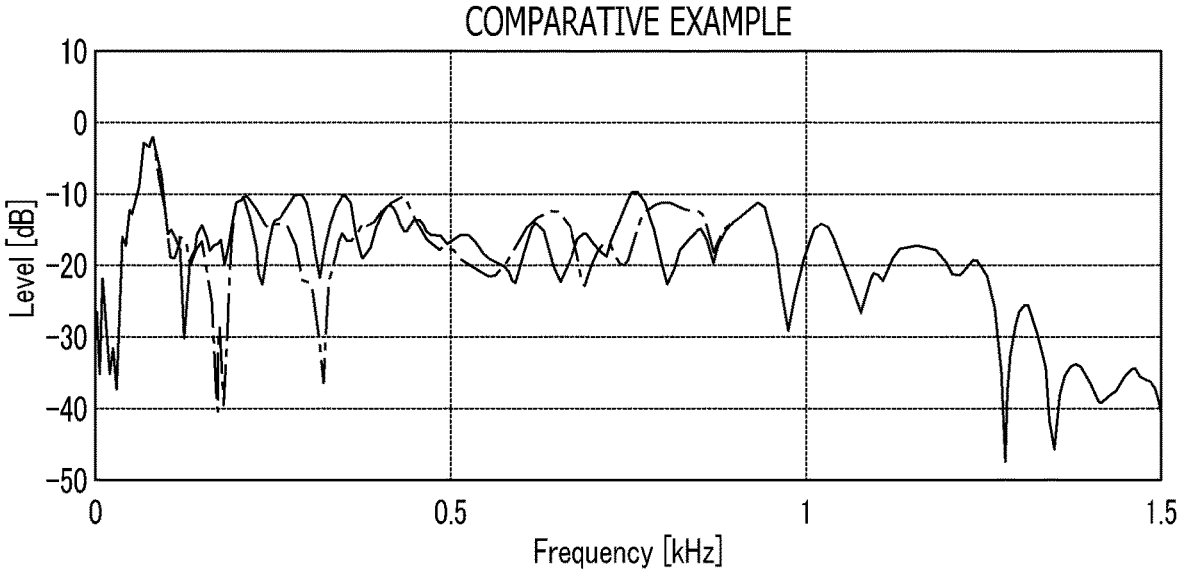
FIG. 17B shows frequency characteristics of the sound observed at the front passenger's seat when the audio signals are output simultaneously from respective speakers using the conventional filter coefficients.

FIG. 17A shows the impulse response observed at the front passenger's seat when the audio signals are output simultaneously from the speakers $SP_{FR}$ and $SP_{FL}$ in the comparative example. FIG. 17B shows the frequency characteristics of the sound observed at the front passenger's seat when the audio signal is output simultaneously from the speakers $SP_{FR}$ and $SP_{FL}$ in the comparative example.

In each of FIGS. 16A and 17A, the vertical axis indicates the amplitude (unitless due to normalized values), and the horizontal axis indicates the time (unit: sec). In each of FIGS. 16B and 17B, the vertical axis indicates the sound pressure level (unit: dB), and the horizontal axis indicates the frequency (unit: Hz). In these figures, the solid line shows the characteristics of the sound observed at the driver's seat when the audio signal is output simultaneously from the speakers $SP_{FR}$ and $SP_{FL}$ with the conventional filter coefficients convolved into the signal input to the speaker $SP_{FR}$, and the single-dotted lines show the characteristics of the sound observed at the driver's seat when the audio signal is output simultaneously from the speakers $SP_{FR}$ and $SP_{FL}$ without convolving the conventional filter coefficients into the signal input to the speaker $SP_{FR}$ (i.e., without filter control by the FIR filter 110).

In the examples of FIGS. 16A, 16B, 17A and 17B, the impulse response, which is obtained by smoothing the phase adjustment amount of each frequency point of the frequency spectrum Rf shown in FIG. 9 using a low-pass filter with FIR with 8 taps and converting by the inverse Fourier transform, is referred to as a "conventional filter coefficient." That is, the "conventional filter coefficient" is a filter coefficient which is generated without performing the process of converting the phase of the leading phase band to the lagging phase.

In the examples of FIGS. 14A to 17B, the filter coefficients are generated based on the phase adjustment amount (see FIG. 8) to make the phase of the sounds from the speaker $SP_{FR}$ and the phase of the sound from the speaker $SP_{FL}$ substantially in-phase at the driver's seat. Therefore, as shown in FIG. 14B and FIG. 16B, the sound pressure level between the target speaker $SP_{FR}$ and the driver's seat is improved in the phase control range of 50 Hz to 1 kHz in both the present example and the comparative example. In addition, in the present example (see FIG. 14A), since the filter coefficients FC (i.e., the filter coefficients obtained by converting the first and second lagging phase data, in which the phase of the leading phase band is converted to the lagging phase, into an impulse response) is convolved with the audio signal $S_R$, so that the leading phase, which causes the generation of pre-echo, is effectively eliminated from the audio signal $S_R$, the pre-echo is reduced compared to the comparative example (see FIG. 16A). Specifically, the amplitude which appears between 0 ms and about 30 ms in FIG. 16A is suppressed in FIG. 14A.

Since the front passenger's seat is relatively close to the driver's seat, as shown in FIGS. 15B and 17B, the sound pressure level between the target speaker $SP_{FR}$ and the front passenger's seat is somewhat improved in the phase control range of 50 Hz to 1 kHz in both the present example and the comparative example. Further, in the present example (see FIG. 15A), by convolving the filter coefficients FC into the audio signal $S_R$, the leading phase that causes pre-echoes is practically eliminated from the audio signal $S_R$, and thus the pre-echoes are reduced at the front passenger's seat compared to the comparative example (see FIG. 17A). Specifically, the amplitude which appears between 0 ms and about 30 ms in FIG. 17A is suppressed in FIG. 15A.

It is noted that aspects of the present disclosures should not be limited to the configuration of the above-described embodiments, but various modifications are possible within aspects of the technical concept of the present disclosures. For example, an appropriate combination of configurations explicitly or inexplicitly disclosed or suggested in the above description may be fallen within aspects of the present disclosures.

In the above embodiment, a case where the impulse response is measured at the driver's seat is described, but the same process may be performed for each seat. In such a case, the controller 100 may retain the filter coefficients FC generated when the impulse responses are measured at respective seats as preset data. The listener may arbitrarily switch the filter coefficients FC for reducing the pre-echo by operating the operation panel 104 to select the preset data.

The above embodiment describes the process when two front speakers are arranged in the vehicle interior. Aspects of the present disclosure should not be limited to such a configuration, and the same process can be used to generate filter coefficients FC for reducing pre-echo when more speakers are arranged in the vehicle interior.

As an example, it is considered a case where two rear speakers are further arranged in the vehicle interior in addition to the two front speakers (i.e., a total of four speakers). In such a case, the frequency spectrum of the impulse response between each speaker and the listening position (i.e., four impulse responses) is obtained in steps S101 to S105, the phase adjustment amount (e.g., the frequency spectrum Rf corresponding to the target speaker $SP_{FR}$) is calculated to make the phase of the sound from each of the four speakers substantially in-phase at the listening position in steps S106 to S107, the amount of the phase adjustment to make the phase of the sound from each of the four speakers substantially in-phase at the listening position (e.g., the phase adjustment amount for each frequency point of the frequency spectrum Rf corresponding to the target speaker $SP_{FR}$) is obtained in steps S106 to S107, the leading phase band is detected in steps S108 to S112, and the filter coefficients are generated after converting the phase of the leading phase band to the lagging phase in steps S113 to S116. As a result, the filter coefficients FC for reducing the pre-echo in an acoustic system with four speakers are generated.

In another embodiment, both the speakers $SP_{FR}$ and $SP_{FL}$ may be the target speakers to be controlled. In such a case, in S106 to S107, the phase adjustment amount to make the phase of the sound from each speaker substantially in-phase at the listening position is obtained for both the frequency spectrum Rf and the frequency spectrum Lf, and in S108 to S116, the filter coefficients corresponding to the speakers $SP_{FR}$ and $SP_{FL}$, respectively, are generated. In this way, a plurality of speakers including the speaker closest to the listening position may be the target speakers to be controlled.

In the above embodiment, in order to increase the sound pressure at the listening position, the leading phase band is detected based on the phase adjustment amount at each frequency point to make the phase of the sound from each speaker substantially in-phase at the listening position, and the filter coefficients are generated after converting the phase of this leading phase band to the lagging phase. However, the present disclosures are not necessarily be limited to such a configuration. For example, to improve the sound quality at the listening position, the leading phase band may be detected based on the phase adjustment amount for each frequency point, which is suitable for reducing peaks and dips in the frequency domain at the listening position, and the filter coefficients may be generated after converting the phase of this leading phase band to a lagging phase.

What is claimed is:

1. A signal processing device, comprising:

a measuring section configured to measure an impulse response between each of a plurality of speakers and a predetermined listening position from a signal of each of sounds respectively output from the plurality of speakers at timings at which the sounds do not interfere with each other at the predetermined listening position and collected at the listening position;

a Fourier transformer configured to obtain a frequency spectrum corresponding to each of the plurality of speakers by applying a Fourier transform to the impulse responses corresponding to each of the plurality of speakers, respectively;

a phase adjustment amount calculator configured to calculate, based on the frequency spectrum corresponding to each speaker, a phase adjustment amount for each frequency of a sound signal input to a target speaker subjected to control of a phase of the sound signal;

a band detector configured to detect a leading phase band including a leading phase based on the phase adjustment amount for each frequency calculated by the phase adjustment amount calculator;

the leading phase converter configured to convert a phase of the leading phase band detected by the band detector to a lagging phase; and a filter coefficient generator configured to generate a filter coefficient corresponding to the target speaker based on the phase adjustment amount after conversion by the phase converter.

2. The signal processing device according to claim 1, wherein the band detector is configured to detect a band including a frequency at which the phase adjustment amount is equal to or larger than a predetermined threshold as the leading phase band.

3. The signal processing device according to claim 1, wherein the band detector is configured to:

allocate the phase adjustment amount for each frequency calculated by the phase adjustment amount calculator to a positive phase adjustment amount or a negative phase adjustment amount;

convert the negative phase adjustment amount to an absolute value;

apply synthesis to the positive phase adjustment amount and the phase adjustment amount converted to the absolute values; and detect the leading phase band based on the phase adjustment amount for each frequency after the synthesis.

4. The signal processing device according to claim 3, wherein the band detector is configured to:

apply smoothing to the phase adjustment amount for each frequency after the synthesizing in a frequency domain; and detect the leading phase band based on the phase adjustment amount for each frequency after the smoothing.

5. The signal processing device according to claim 1, wherein the phase converter is configured to:

generate first lagging phase data in which the lagging phase is shifted in a negative side every time a starting frequency of the leading phase band appears in the frequency domain; and generate second lagging phase data in which the lagging phase is shifted in the negative side every time an ending frequency of the leading phase band appears in the frequency domain, and wherein the filter coefficient generator generates the filter coefficient based on the first lagging phase data and the second lagging phase data.

6. The signal processing device according to claim 5, wherein the phase converter is configured to apply smoothing to the first lagging phase data and the second lagging phase data with respect to a frequency axis.

7. The signal processing device according to claim 5, wherein the filter coefficient generator is configured to:

convert each of the first lagging phase data and the second lagging phase data to an impulse response; and obtain the filter coefficient by convoluting the impulse response obtained by converting the first lagging phase data and the impulse response obtained by converting the second lagging phase data, the convoluted impulse response being the filter coefficient.

8. The signal processing device according to claim 1, further comprising an FIR filter configured to convolute the filter coefficient generated by the filter coefficient generator into the sound signal to be input to the target speaker.

9. A non-transitory computer-readable recording medium for a signal processing device, the recording medium containing computer-executable instructions which cause, when executed, the signal processing device to perform:

measuring an impulse response between each of a plurality of speakers and a predetermined listening position from a signal of each of sounds respectively output from the plurality of speakers at timings at which the sounds do not interfere with each other at the predetermined listening position and collected at the listening position;

obtaining a frequency spectrum corresponding to each of the plurality of speakers by applying a Fourier transform to the impulse responses corresponding to each of the plurality of speakers, respectively;

calculating, based on the frequency spectrum corresponding to each speaker, a phase adjustment amount for each frequency of a sound signal input to a target speaker subjected to control of a phase of the sound signal;

detecting a leading phase band including a leading phase based on the phase adjustment amount for each frequency;

converting the leading phase of the leading phase band detected to a lagging phase; and generating a filter coefficient corresponding to the target speaker based on the phase adjustment amount after the converting.

10. A signal processing method performed in a signal processing device including:

measuring an impulse response between each of a plurality of speakers and a predetermined listening position from a signal of each of sounds respectively output from the plurality of speakers at timings at which the sounds do not interfere with each other at the predetermined listening position and collected at the listening position;

obtaining a frequency spectrum corresponding to each of the plurality of speakers by applying a Fourier transform to the impulse responses corresponding to each of the plurality of speakers, respectively;

calculating, based on the frequency spectrum corresponding to each speaker, a phase adjustment amount for each frequency of a sound signal input to a target speaker subjected to control of a phase of the sound signal;

detecting a leading phase band including a leading phase based on the phase adjustment amount for each frequency;

converting the leading phase of the leading phase band detected to a lagging phase; and generating a filter coefficient corresponding to the target speaker based on the phase adjustment amount after the converting.

* * * * *